US008104860B2

(12) United States Patent
Ito

(10) Patent No.: US 8,104,860 B2
(45) Date of Patent: Jan. 31, 2012

(54) INK-JET RECORDING APPARATUS INCLUDING ABNORMALITY JUDGING PORTION

(75) Inventor: Koji Ito, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 693 days.

(21) Appl. No.: 12/235,561

(22) Filed: Sep. 22, 2008

(65) Prior Publication Data

US 2009/0085953 A1 Apr. 2, 2009

(30) Foreign Application Priority Data

Sep. 28, 2007 (JP) ..... 2007-253748
Sep. 28, 2007 (JP) ..... 2007-255695

(51) Int. Cl.
*B41J 29/393* (2006.01)

(52) U.S. Cl. ..... 347/19; 347/72

(58) Field of Classification Search ..... 347/68–72, 347/19

See application file for complete search history.

(56) References Cited

U.S. PATENT DOCUMENTS 6,513,434 B1 * 2/2003 Nakazawa et al. ..... 101/466
7,360,874 B2 * 4/2008 Watanabe et al. ..... 347/71
7,387,374 B2 * 6/2008 Kawamura ..... 347/72
7,416,279 B2 * 8/2008 Isono ..... 347/50
7,475,967 B2 * 1/2009 Nakagawa et al. ..... 347/68
7,841,685 B2 * 11/2010 Ito ..... 347/19
2002/0024567 A1 * 2/2002 Takagi ..... 347/72
2002/0071004 A1 * 6/2002 Kaneko ..... 347/58
2005/0212844 A1 * 9/2005 Nishihara ..... 347/19
2007/0046714 A1 * 3/2007 Beak et al. ..... 347/19

FOREIGN PATENT DOCUMENTS

JP 2-45153 * 2/1990
JP 2002-036568 A 2/2002
JP 2002-127405 A 5/2002

* cited by examiner

*Primary Examiner* — Charlie Peng
(74) *Attorney, Agent, or Firm* — Baker Botts L.L.P.

(57) ABSTRACT

An ink-jet recording apparatus, including: a flow-passage unit; a plurality of actuators including a plurality of individual electrodes; a plurality of signal output circuits; a power supply device; an electric current detecting device; and a control device including an abnormality judging portion which judges that there exists an abnormality among (a) at least one of the signal output circuits corresponding to at least one test-target individual electrode that is at least a part of the individual electrodes and (b) at least one of the actuators corresponding to the at least one test-target individual electrode, on the basis of a current change amount that is a difference between a first current value and a second current value, the first current value being detected by the detecting device when each of the signal output circuits outputs a first signal for giving a first potential and the second current value being detected by the detecting device when each of the at least one of the signal output circuits outputs a second signal for giving a second potential while each of the rest of the signal output circuits which excludes the at least one of the signal output circuits output the first signal.

13 Claims, 14 Drawing Sheets

INK-JET RECORDING APPARATUS INCLUDING ABNORMALITY JUDGING PORTION

CROSS REFERENCE TO RELATED APPLICATION

The present application claims priority from Japanese Patent Application Nos. 2007-253748 and 2007-255695, which were filed on Sep. 28, 2007, the disclosure of which is herein incorporated by reference to its entirety.

BACKGROUND OF THE INVENTION

1. Field of the Invention

The present invention relates in general to an ink-jet recording apparatus which performs recording or printing by ejecting ink droplets.

2. Discussion of Related Art

An ink-jet head of an ink-jet printer for ejecting ink droplets onto a recording medium such as a recording sheet includes: a flow-passage unit in which are formed nozzles through which ink droplets are ejected and pressure chambers which communicate with the nozzles; actuators which apply an ejection energy to ink in the pressure chambers; and a driver IC in which are incorporated signal output circuits which output drive signals for driving the actuators. As the actuators each configured to apply a pressure to the ink in the pressure chambers by changing the volume thereof, there is known one disclosed in Patent Document 1 including: a piezoelectric sheet (piezoelectric layer) extending over a plurality of pressure chambers; a plurality of individual electrodes facing respectively the plurality of pressure chambers; and a common electrode (ground electrode) which faces the plurality of individual electrodes via the piezoelectric sheet and to which a base potential is given. In the disclosed actuators, when a drive pulse signal outputted from the signal output circuit of the driver IC is inputted to one of the individual electrodes, an electric field is generated at a portion of the piezoelectric sheet interposed between the above-indicated one individual electrode and the common electrode in a thickness direction of the piezoelectric sheet, so that the piezoelectric sheet at that portion expands or elongates in the thickness direction. Accordingly, the volume of the pressure chamber that corresponds to the one individual electrode is changed, whereby the pressure (ejection energy) is given to the ink in that pressure chamber.

In the driver IC, transistors and protective diodes of each signal output circuit are degraded due to latch-up, a surge arising from electrostatic discharge, etc., so that a leak current is generated. Heat generated by the leak current may break the signal output circuit. When an abnormality occurs in the signal output circuit, it is impossible to sufficiently apply an electric field to the piezoelectric sheet, so that the actuator cannot be driven at a high speed. Meanwhile, in each actuator, the piezoelectric sheet may suffer from a crack occurred therein. In this instance, the displacement amount of the piezoelectric sheet is reduced, thereby reducing the drive force of the actuator. If the actuator is continuously driven with the crack occurred in the piezoelectric sheet, the crack is enlarged, so that the ink enters the inside of the actuator through the crack, causing a risk of generating a short circuit in the actuator and the wiring connected thereto.

To monitor an abnormality in the driver IC and the actuators, there has been proposed, in Patent Document 2, a technique of monitoring an electric current in each signal output circuit by providing an electric current detecting circuit for each of the signal output circuits that correspond to the respective actuators.

Patent Document 1 JP 2002-36568 (FIG. 1)

Patent Document 2 JP 2002-127405 (FIG. 1)

SUMMARY OF THE INVENTION

Where the electric current detecting circuit is provided for each of the signal output circuits that correspond to the respective actuators as disclosed in the above-indicated Patent Document 2, the cost of manufacture of the ink-jet printer is inevitably increased and the control circuit for the actuators tends to be large-sized.

It is therefore an object of the present invention to provide an ink-jet recording apparatus which ensures a reduction in its size and its manufacturing cost while judging whether there exists an abnormality in actuators or signal output circuits.

The above-indicated object may be attained according to a principle of the invention, which provides an ink-jet recording apparatus, comprising:

a flow-passage unit including a plurality of pressure chambers, a plurality of nozzles provided so as to respectively correspond to the plurality of pressure chambers, and a plurality of individual ink passages through which the plurality of pressure chambers respectively communicate with the plurality of nozzles;

a plurality of actuators including a plurality of individual electrodes provided so as to respectively correspond to the plurality of pressure chambers, a ground electrode which is disposed so as to face to the plurality of individual electrodes and to which a base potential is given, and a piezoelectric layer interposed between the plurality of individual electrodes and the ground electrode;

a plurality of signal output circuits which are provided so as to respectively correspond to the plurality of actuators and each of which outputs a signal for giving a potential to a corresponding one of the plurality of individual electrodes;

a power supply device which supplies, to the plurality of signal output circuits, an electric power for giving the potential to the plurality of individual electrodes;

an electric current detecting device which detects an electric current with respect to the electric power supplied by the power supply device; and a control device which executes a control of the ink-jet recording apparatus and which includes an abnormality judging portion which judges that there exists an abnormality among (a) at least one of the plurality of signal output circuits which corresponds to at least one test-target individual electrode that is at least a part of the plurality of individual electrodes and (b) at least one of the plurality of actuators which corresponds to the at least one test-target individual electrode, on the basis of a current change amount that is a difference between a first current value and a second current value, the first current value being detected by the electric current detecting device when each of the plurality of signal output circuits outputs a first signal for giving a first potential and the second current value being detected by the electric current detecting device when each of the at least one of the plurality of signal output circuits outputs a second signal for giving a second potential different from the first potential while each of the rest of the plurality of signal output circuits which excludes the at least one of the plurality of signal output circuits output the first signal.

Where there occur abnormalities such as an increase of a leak current in transistors of signal output circuits, short circuits due to entry of ink into actuators through the crack occurred in a piezoelectric layer, and a reduction in a capacitance of the actuators due to the crack, the electric current flowing in the signal output circuits changes. In the ink-jet recording apparatus constructed as described above, the current change amount is obtained as a difference between the first current value detected by the electric current detecting device when each of the plurality of signal output circuits outputs the first signal for giving the first potential and the second current value detected by the electric current detecting device when each of the at least one of the plurality of signal output circuits which corresponds to the at least one inspection-target individual electrode outputs the second signal for giving a second potential different from the first potential while each of at least one of the plurality of signal output circuits which corresponds to at least one of the plurality of individual electrodes that excludes the at least one inspection-target individual electrode outputs the first signal. On the basis of the current change amount, it is possible to judge whether there exists an abnormality in at least one of: (a) at least one of the plurality of signal output circuits which corresponds to at least one inspection-target individual electrode that is at least a part of the plurality of individual electrodes; and (b) at least one of the plurality of actuators. Accordingly, it is possible to judge the abnormality without providing the electric current detecting circuit for each of the individual electrodes, thereby ensuring a reduction in the size of the ink-jet recording apparatus and the manufacturing cost thereof.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE PREFERRED EMBODIMENTS

There will be described embodiments of the invention with reference to the drawings.

First Embodiment

Figure 1:
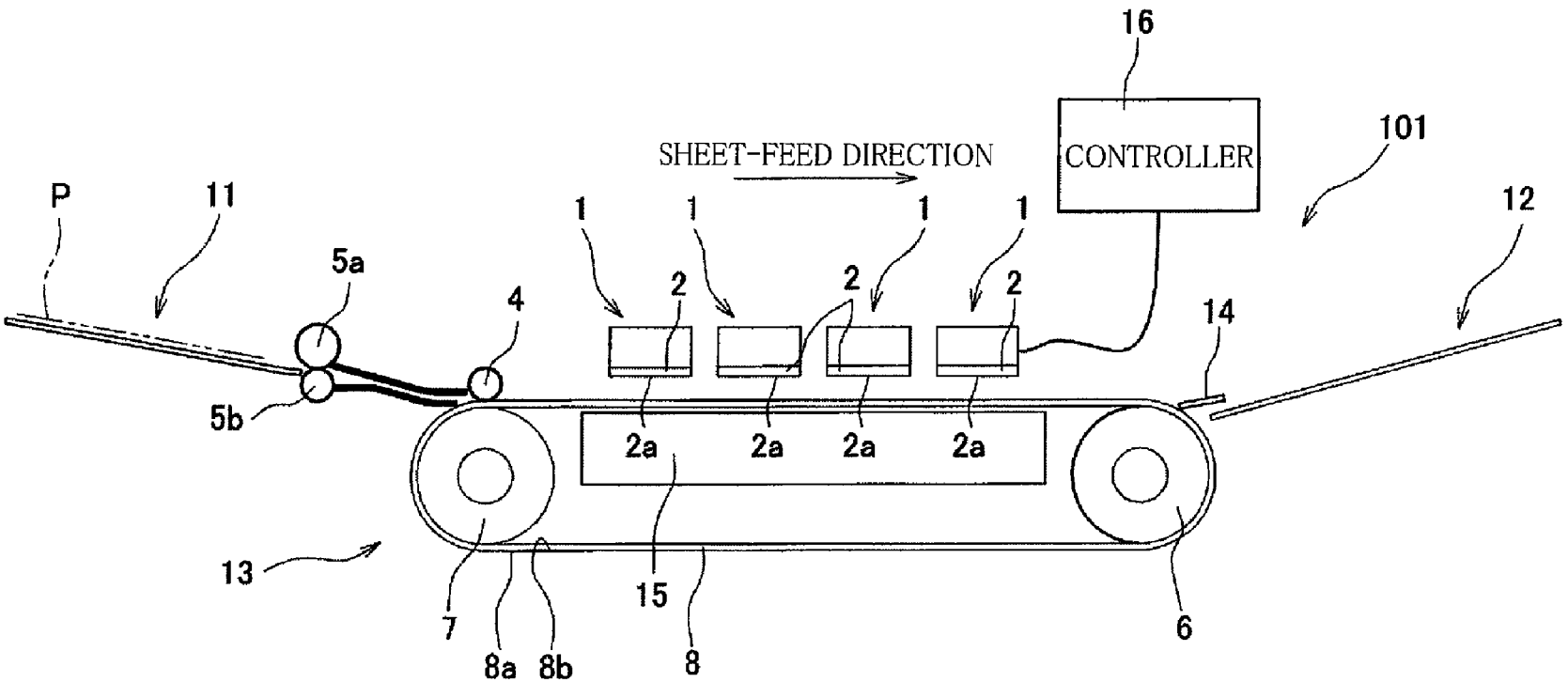
FIG. 1 is an external side view showing an ink-jet printer according to a first embodiment of the present invention.

FIG. 1 is a schematic side elevational view showing an overall structure of an ink-jet printer as an ink-jet recording apparatus, according to a first embodiment of the present invention. The ink-jet printer generally indicated at 101 in FIG. 1 is a color ink-jet printer having four ink-jet heads 1 and a controller 16 for controlling operations of the ink-jet printer 101. In the ink-jet printer 101, a sheet-supply portion 11 and a sheet-discharge portion 12 are disposed respectively at a left-side end portion and a right-side end portion in FIG. 1.

In the inside of the ink-jet printer 101, there is formed a sheet-feed path through which a sheet (as a recording medium) P is fed in a sheet-feed direction from the sheet-supply portion 11 toward the sheet-discharge portion 12. On a downstream side of the sheet-supply portion 11, there is disposed a pair of sheet-feed rollers 5*a*, 5*b* by which the sheet P is fed while being held therebetween. The sheet-feed rollers 5*a*, 5*b* feed the sheet toward a rightward direction in FIG. 1 from the sheet-supply portion 11. At a middle portion in the sheet-feed path, there is disposed a feed mechanism 13 that includes two belt rollers 6, 7, an endless feed belt 8 wound around the two belt rollers 6, 7 so as to be stretched therebetween, and a platen 15 disposed in a region enclosed by the feed belt 8. The platen 15 is for supporting, at a position where the platen 15 faces the ink-jet heads 1, the feed belt 8 such that the feed belt 8 does not deflect downward. Further, a nip roller 4 is disposed so as to face the belt roller 7 for pressing the sheet P fed from the sheet-supply portion 11 by the sheet-feed rollers 5*a*, 5*b*, toward an outer circumferential surface 8*a* of the feed belt 8.

The belt roller 6 is rotated by a feed motor (not shown) and the feed belt 8 is accordingly moved, so that the sheet P pressed by the nip roller 4 onto the outer circumferential surface 8*a* of the feed belt 8 is fed toward the sheet-discharge portion 12 while adhering to and being held by the feed belt 8. The feed belt 8 has a silicone resin layer with low adhesion property formed on the outer circumferential surface 8*a* thereof.

On the downstream side of the feed belt 8 in the sheet-feed direction, there is provided a sheet separation mechanism 14 configured to separate the sheet P adhering to the outer circumferential surface 8*a* of the feed belt 8 and to guide the sheet P toward the sheet-discharge portion 12 disposed at the right-side end portion in FIG. 1.

The four ink-jet heads 1 respectively correspond to inks of four colors, i.e., magenta, yellow, cyan, and black, and are arranged in the sheet-feed direction. Accordingly, the ink-jet printer 101 is of a line type. Each of the four ink-jet heads 1 has a head body 2 at a lower end thereof. The head body 2 is a rectangular parallelepiped having a larger length in a direction perpendicular to the sheet-feed direction. The head boy 2 has a bottom surface functioning as an ink ejection surface 2*a* that faces the outer circumferential surface 8*a* of the feed belt 8. When the sheet P fed on the feed belt 8 passes right below the four head bodies 2, ink droplets of the four colors are ejected from the ink ejection surfaces 2*a* of the respective four head bodies 2 toward a print region on the upper surface or print surface of the sheet P. Thus, a desired color image is formed on the print region of the sheet P.

Figure 2:
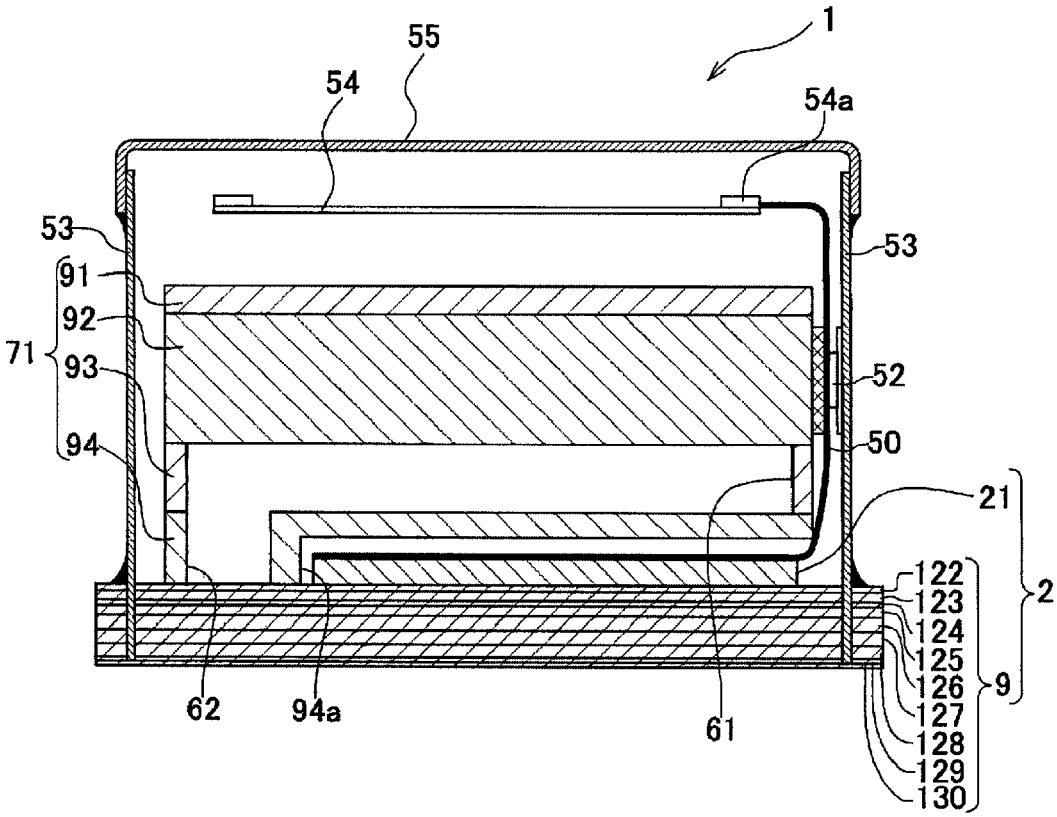
FIG. 2 is a cross sectional view showing an ink-jet head of the ink-jet printer of FIG. 1 taken along a width direction of the ink-jet head.

Referring next to FIG. 2, the ink-jet head 1 will be explained in detail. FIG. 2 is a cross sectional view of the ink-jet head 1 taken along the width direction of the same 1. As shown in FIG. 2, the ink-jet head 1 is constituted by a flow-passage section in which flow passages are formed, an electric-component section for permitting the ink droplets to be ejected from the flow-passage section, and a cover section for protecting the electric-component section. The flow-passage section includes: the head body 2 including a flow-passage unit 9 and actuator units 21; and a reservoir unit 71 disposed on the upper surface of the head body 2. The reservoir unit 71 temporarily stores the ink to be supplied to the head body 2. The electric-component section includes: a Chip On Film (COF) 50 on which driver ICs 52 are mounted; and a substrate 54 which is electrically connected to the COF 50. The COF 50 is connected at its one end to the actuator units 21, and a drive signal generated by each driver IC 52 is sent to the corresponding actuator unit 21. The cover section is constituted by side covers 53 and a top cover 55. The cover section accommodates the electric-component section therein for preventing entry of ink and mist of ink thereinto.

The reservoir unit 71 is formed by four plates 91-94 superposed on each other. In the reservoir unit 71, there are formed an ink inlet passage (not shown), an ink reservoir 61, and ten ink outlet passages 62, which are in communication with each other. In FIG. 2, only one of the ten ink outlet passages 62 is shown.

The plate 94 has a recessed portion 94*a* formed in its surface facing the flow-passage unit 9, so that a clearance is defined between the plate 94 and the flow-passage unit 9. The actuator unit 21 is disposed in the clearance. The ink flowed into the ink reservoir 61 passes through the ink outlet passages 62 and is supplied to the flow-passage unit 9 via respective ink supply holes 105*b* of the flow-passage unit 9.

The COF 50 is bonded, at the vicinity of its one end, to the upper surface of each actuator unit 21 for electrical connection with individual electrodes 135 and a common electrode 134 which will be explained. Further, the COF 50 is drawn upward from the upper surface of each actuator unit 21 so as to extend between one of the side covers 53 and the reservoir unit 71, and is connected, at the other end thereof, to the substrate 54 via a connector 54*a*. The substrate 54 is for relaying drive signals from the controller 16 to each driver IC 52.

Figure 3:
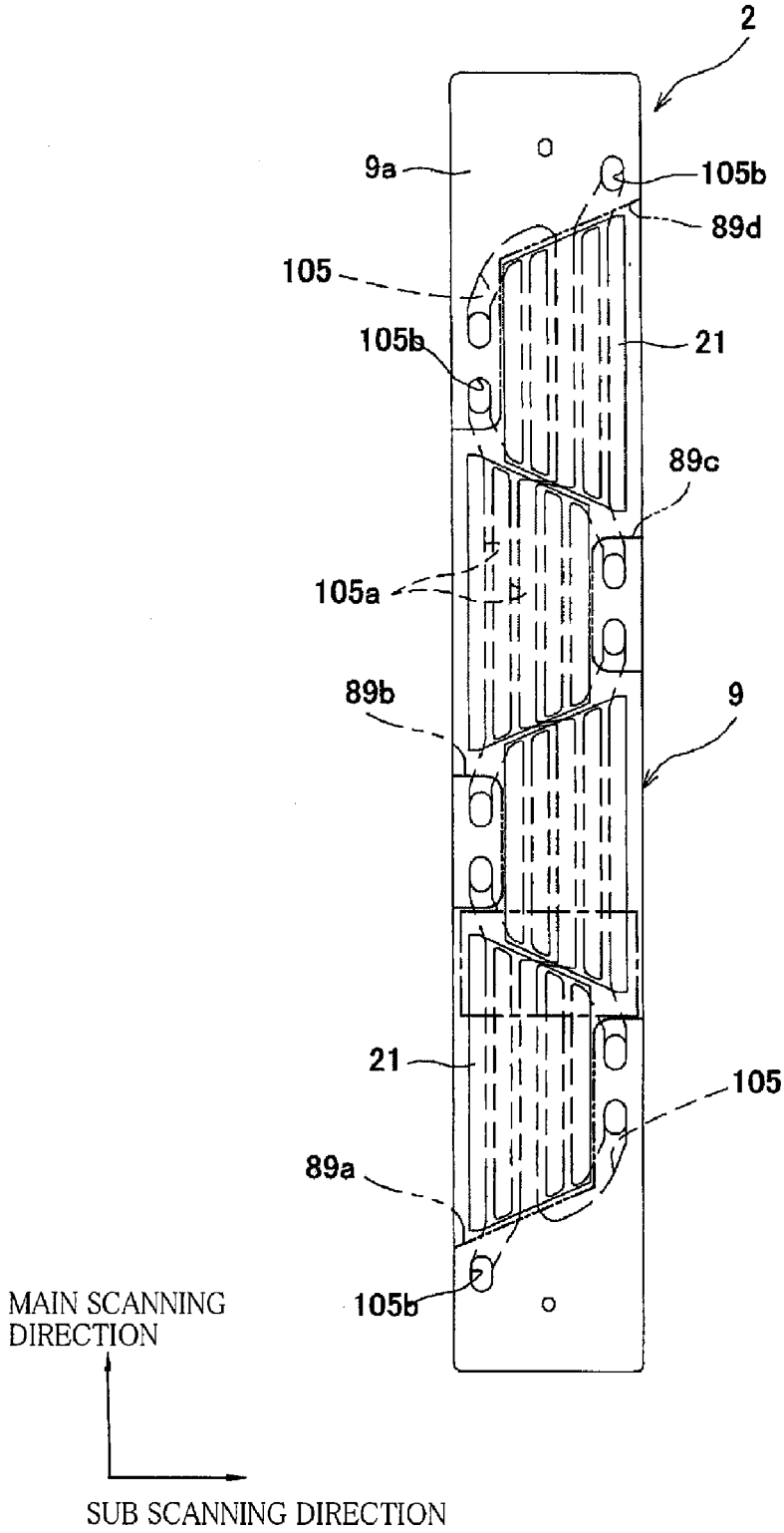
FIG. 3 is a plan view of a head body of the ink-jet head shown in FIG. 2.
Figure 4:
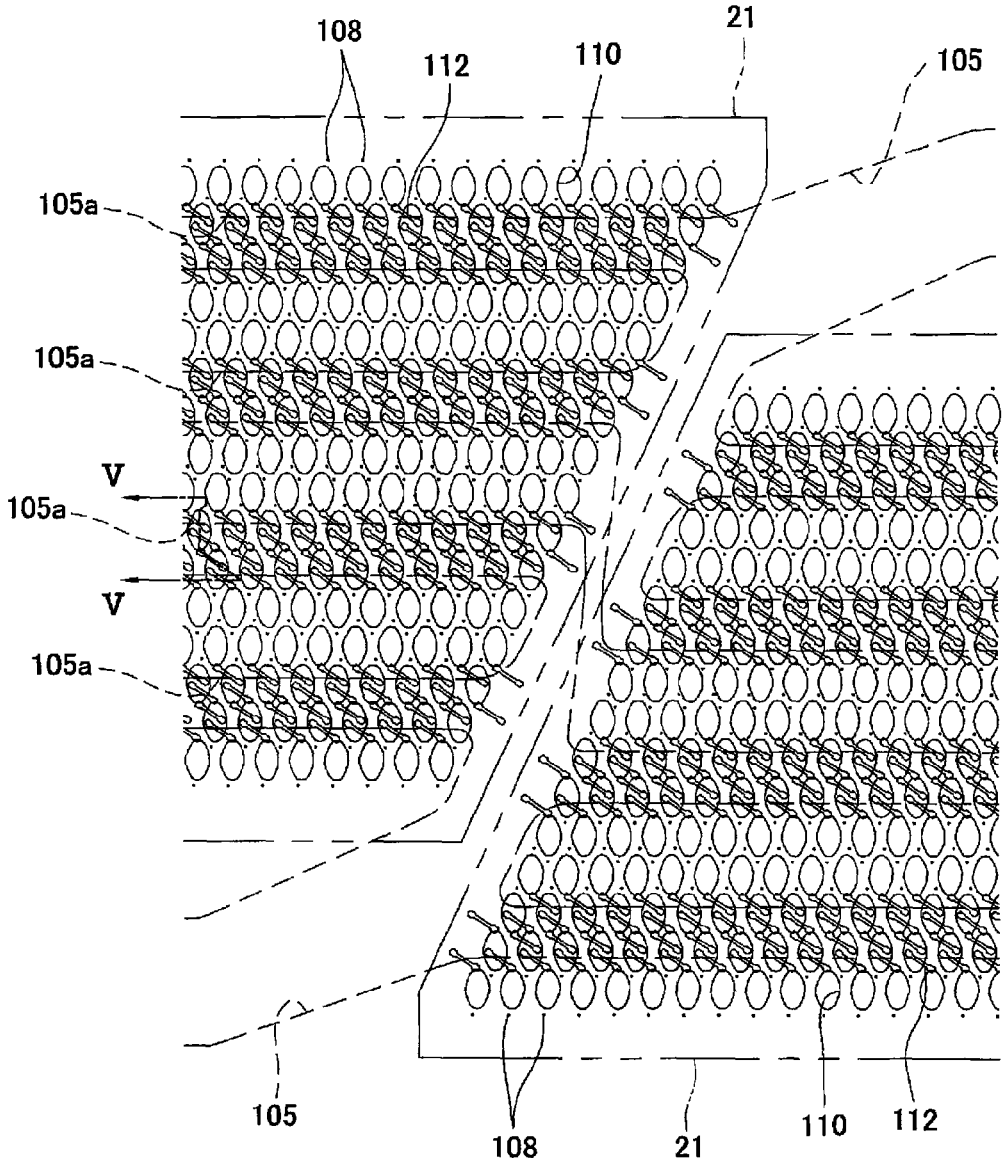
FIG. 4 is an enlarged view of a region enclosed by one-dot chain line in FIG. 3.
Figure 5:
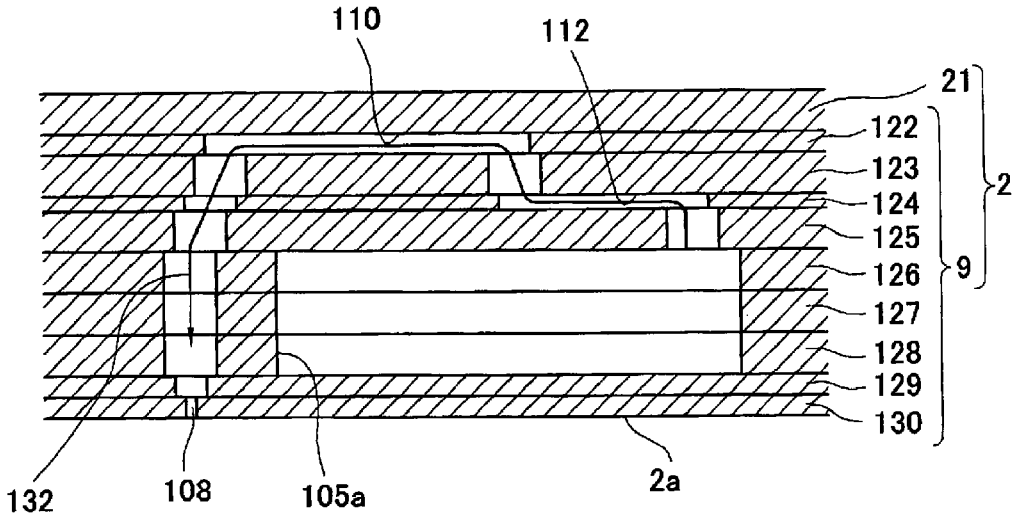
FIG. 5 is a cross sectional view taken along line V-V in FIG. 4.

Referring next to FIGS. 3-6, the head body 2 will be explained. FIG. 3 is a plan view of the head body 2 and FIG. 4 is an enlarged view of a region enclosed by one-dot chain line in FIG. 3. In FIG. 4, pressure chambers 110, apertures 112, and nozzles 108 located below the actuator units 21 are indicated by solid lines instead of broken lines for convenience sake. FIG. 5 is a partial cross sectional view taken along line V-V in FIG. 4. FIG. 6A is an enlarged cross sectional view of the actuator unit 21 and FIG. 6B is a plan view of the individual electrode 135 provided on the actuator unit 21.

As shown in FIG. 3, the head body 2 is constituted by the flow-passage unit 9 and the four actuator units 21 fixed on an upper surface 9*a* of the flow-passage unit 9. As shown in FIG. 4, each actuator unit 21 includes a plurality of actuators provided so as to face the respective pressure chambers 110 formed in the flow-passage unit 9 and has a function of selectively giving an ejection energy to the ink in the pressure chambers 110.

The flow-passage unit 9 is a rectangular parallelepiped having substantially the same shape in plan view as the plate 94 of the reservoir unit 71. The ten ink supply holes 105*b* are open to the upper surface 9*a* of the flow-passage unit 9 so as to respectively correspond to the ten ink outlet passages 62 (FIG. 2) of the reservoir unit 71. In the flow-passage unit 9, there are formed: manifolds 105 communicating with the corresponding ink supply holes 105*b*; and sub manifolds 105*a* branched from the corresponding manifolds 105. On a lower surface of the flow-passage unit 9, the ink ejection surface 2*a* is formed in which a multiplicity of the nozzles 108 are arranged in a matrix, as shown in FIGS. 4 and 5. Like the nozzles 108, the pressure chambers 110 are formed in a matrix on the upper surface 9*a* of the flow-passage unit 9 to which the actuator units 21 are fixed.

The flow-passage unit 9 is constituted by nine metal plates 122-130 each formed of stainless steel or the like and each having a rectangular shape in plan view that is elongate in a main scanning direction.

The plates 122-130 are superposed on each other while being aligned with each other, whereby through-holes formed in the respective plates 122-130 are connected to each other to form, in the flow-passage unit 9, a multiplicity of individual ink passages 132 extending from the manifolds 105 to the nozzles 108 via the sub manifolds 105*a* and the pressure chambers 110.

The ink supplied from the reservoir unit 71 into the flow-passage unit 9 flows into the individual ink passages 132 from the manifolds 105 (the sub manifolds 105*a*) and reaches the nozzles 108 via the apertures or orifices 112 and the pressure chambers 110.

The actuator unit 21 will be explained. As shown in FIG. 3, the four actuator units 21 have a trapezoidal shape in plan view and are arranged in a zigzag fashion so as not to overlap the ink supply holes 105*b*. Two parallel sides in each of the trapezoidal actuator units 21 extend in a longitudinal direction of the flow-passage unit 9 while two oblique sides of adjacent two actuator units 21 partially overlap each other with respect to the width direction of the flow-passage unit 9, namely, in a sub scanning direction.

Figure 6A:
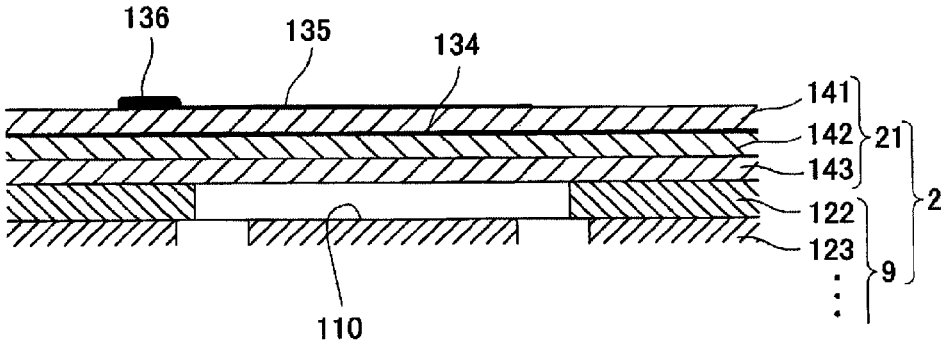
FIG. 6A is an enlarged cross sectional view of an actuator unit of FIG. 4
Figure 6B:
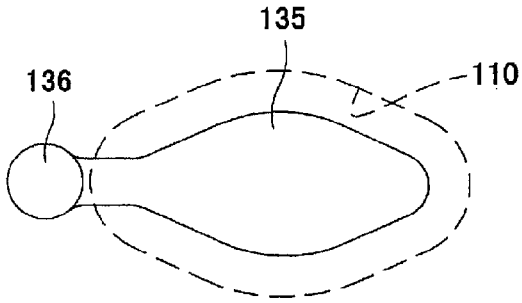
FIG. 6B is a plan view of an individual electrode disposed on a surface of the actuator unit.

As shown in FIG. 6A, each actuator unit 21 is constituted by three piezoelectric sheets or layers 141-143 each of which is formed of a ceramic material of lead zirconate titanate (PZT) having ferroelectricity. The individual electrodes 135 are formed at portions of the upper surface of the uppermost piezoelectric sheet 141 that correspond to the respective pressure chambers 110. The common electrode (ground electrode) 134 is interposed between the uppermost piezoelectric sheet 141 and the piezoelectric sheet 142 located under the sheet 141, so as to extend over entire surfaces of the sheets 141, 142. As shown in FIG. 6B, each individual electrode 135 has a generally rhombic shape in plan view similar to the pressure chambers 110. One acute end of the individual electrode 135 is extended, and a circular conductive land 136 is provided at the extended end.

Figure 8:
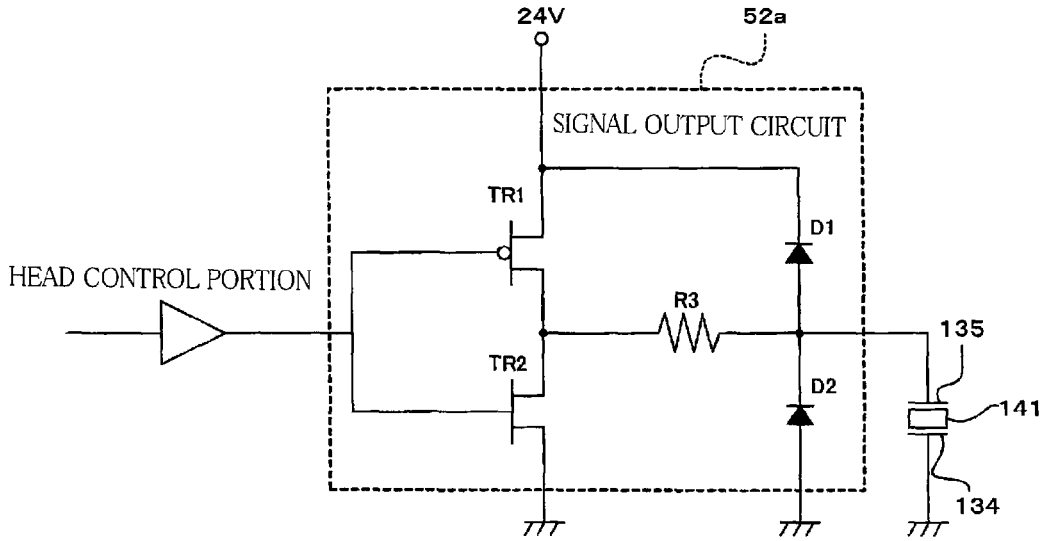
FIG. 8 is a circuit diagram of a signal output circuit of a driver IC shown in FIG. 2.

In each actuator unit 21, the common electrode 134 is given a ground potential (base potential). The individual electrodes 135 are electrically connected to respective signal output circuits 52*a* as shown in FIG. 8 provided in the driver IC 52, via the corresponding lands 136 and the internal wiring of the COF 50. In each actuator unit 21, a portion sandwiched by and between each individual electrode 135 and a corresponding one of the pressure chambers 110 functions as one actuator.

The manner of driving or activating the actuator unit 21 will be explained. The piezoelectric sheet 141 is sandwiched by and between the multiplicity of individual electrodes 135 and the common electrode 134 while the piezoelectric sheets 142, 143 are sandwiched by and between the common electrode 134 and the upper surface 9*a* of the flow-passage unit 9.

A portion of the piezoelectric sheet 141 sandwiched by and between each individual electrode 135 and the common electrode 134 functions as an active layer which is configured to contract or expand in a direction parallel to the surface of the sheet 141 (hereinafter referred to as "surface direction") upon application of a voltage between the electrodes 135, 134. The portion functioning as the active layer deforms so as to change the volume of the corresponding pressure chamber 110, cooperating with the piezoelectric sheets 142, 143 that are nearer to the pressure chambers 110 than the sheet 141. Where the polarization direction of the active layer and the direction of the electric field are both in the thickness direction of the sheets 141-143, the active layer contracts in the surface direction, and a portion of the sheets 141-143 corresponding to the individual electrode 135 deforms convexly toward the corresponding pressure chamber 110 (i.e., unimorph deformation). Accordingly, a pressure (ejection energy) is given to the ink in the pressure chamber 110 and therefore a pressure wave is generated in the same 110. The generated pressure wave propagates from the pressure chamber 110 to the corresponding nozzle 108, so that the ink droplet is ejected from the nozzle 108.

In the present embodiment, each individual electrode 135 is given a drive potential, whereby the volume of the corresponding pressure chamber 110 is decreased. Each time when an ejection requirement is made, there is outputted from the driver IC 52 a drive signal for once giving a ground potential to the individual electrode 135 and again giving the drive potential thereto at suitable timing. In this instance, at timing when the potential of the individual electrode 135 becomes equal to the ground potential, the pressure of the ink in the corresponding pressure chamber 110 decreases, namely, the volume of the pressure chamber 110 increases, so that the ink is sucked from the corresponding sub manifold 105*a* into the corresponding individual ink passage 132. Subsequently, at timing when the potential of the individual electrode 135 becomes again equal to the drive potential, the pressure in the pressure chamber 110 increases, namely, the volume of the pressure chamber 110 decreases, so that the ink droplet is ejected from the corresponding nozzle 108. That is, a pulse with a rectangular waveform is applied to the individual electrode 135. The width of the pulse is slightly shorter than an acoustic length AL which is a time length required for the pressure wave to propagate from the outlet of the sub manifold 105*a* to the leading end of the nozzle 108 through the pressure chamber 110. However, when the pressure of the ink in the pressure chamber 110 changes from the negative pressure state to the positive pressure state, the ink droplet can be ejected from the nozzle 108 by a strong pressure because the pressure generated upon the volume decrease is added. Although it is preferable that the pulse width be equal to the acoustic length AL for ejecting the ink droplet with a strong pressure, the pulse width is made slightly shorter, in the present embodiment, than the acoustic length AL so as not to exceed the acoustic length AL because the individual ink passages 132 suffer from dimensional variations due to production errors in the flow-passage unit 9. In the present embodiment, the drive potential is equal to 24V In the ink ejecting operation by the actuator unit 21, when the potential of the individual electrode 135 is changed from the ground potential to the drive potential (e.g., 24V) and vice versa, a transient current flows. When the potential of the individual electrode 135 is changed from the ground potential to the drive potential, the transient current is supplied by a control power supply device 85. When the potential of the individual electrode 135 is changed from the ground potential to the drive potential, the charging current flows to the individual electrode 135. When the potential of the individual electrode 135 is changed from the drive potential to the ground potential, the discharging current flows from the individual electrode 135. Where there are no deficiencies in the actuator units 21 and the driver ICs 52 (the signal output circuits 52*a*), a prescribed transient current flows each time when the potential of the individual electrode 135 changes. In the present embodiment, the transient current flows for about 1 μsec immediately after the voltage transition.

Figure 7:
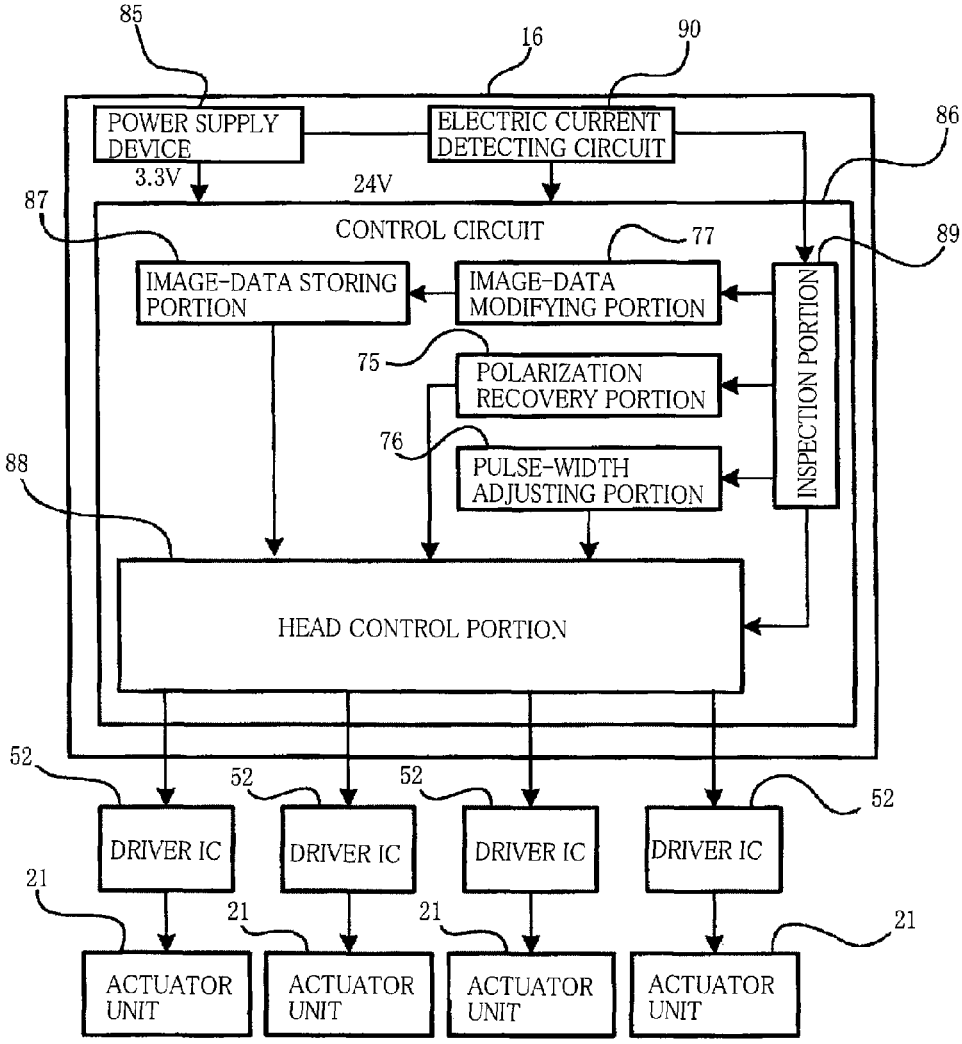
FIG. 7 is a functional block diagram of a controller shown in FIG. 1.

Referring next to the functional block diagram of FIG. 7, the controller 16 will be explained. As shown in FIG. 7, the controller 16 includes: a power supply device 85, an electric current detecting circuit 90 as an electric current detecting device, and a control circuit 86 as a control device. The power supply device 85 includes a 3.3V-system output circuit for operating the control circuit 86 and a 24V-system output circuit for driving the actuator units 21. The output of a 24V-system electric power to be outputted from the 24V-system output circuit is supplied to each driver IC 52 via the control circuit 86. The electric current detecting circuit 90 detects an electric current at an output portion of the power supply device 85 that outputs the 24V-system electric power. The result of detection by the electric current detecting circuit 90 is sent to an inspection portion 89 (which will be described) of the control circuit 86.

The control circuit 86 is for controlling activation of each actuator unit 21 and includes an image-data storing portion 87, a head control portion 88, the inspection portion 89 as an abnormality judging portion, a polarization recovery portion 75 as a recovery portion, a pulse-width adjusting portion 76, and an image-data modifying portion 77. The image-data storing portion 87 stores image data of an image to be printed on the sheet P. The image data includes dot data relating to each of dots of the image to be printed. The dot data represents a volume of an ink droplet to be ejected from each nozzle 108 toward the sheet P. In the present embodiment, the dot data is constituted such that the volume of the ink droplet is represented in four tones, i.e., no ejection, a small volume, a medium volume, and a large volume.

The head control portion 88 controls activation of the actuator units 21 via the corresponding driver ICs 52, such that the ink droplet is ejected from each nozzle 108 at predetermined timing according to the image data stored in the image-data storing portion 87. Each driver IC 52 includes a plurality of signal output circuits 52*a* for driving or activating respective actuators (hereinafter referred to as "channels" where appropriate) which are formed in the corresponding actuator unit 21 and which correspond to the respective nozzles 108.

Referring next to the circuit diagram of FIG. 8, the operation of each signal output circuit 52*a* of the driver IC 52 will be explained. As shown in FIG. 8, the signal output circuit 52*a* includes: a p-channel transistor (MOS FET) TR1; an n-channel transistor (MOS FET) TR2; protective diodes D1, D2 each of which is disposed between a drain and a source of a corresponding one of the transistor TR1 and the transistor TR2; and a drive resistor R3.

The drain of the transistor TR1 and the source of the transistor TR2 are connected. The output terminal of the head control portion 88 is connected to gates of the respective transistors TR1, TR2, and a control signal from the head control portion 88 is inputted to the transistors TR1, TR2. The drive resistor R3 is disposed between the individual electrode 135 and a connection of the two transistors TR1, TR2. The electric current value to be supplied to the individual electrode 135 is determined by the drive resistor R3. Where the control signal is at a Low level, the transistor TR1 turns on while the transistor TR2 turns off. In this state, the potential of 24V is given to the individual electrode 135 via the drive resistor R3, whereby the corresponding channel is charged. Where the control signal is at a High level, on the other hand, the transistor TR1 turns off while the transistor TR2 turns on. In this state, the ground potential is given to the individual electrode 135 via the drive resistor R3, whereby the corresponding channel is discharged. Thus, the signal output circuit 52*a* is an inverter circuit configured to give, to the corresponding individual electrode 135, drive signals of 24V system logically inverted with respect to the control signal of 3.3V system from the head control portion 88.

When the control signal from the head control portion 87 changes from the High level to the Low level or vice versa, both of the transistors TR1, TR2 simultaneously turn on for a moment, and a through current flows through the both of the transistors TR1, TR2. To prevent the through current, a through-current preventive circuit that adjusts the transition timing of the signal level may be provided between the head control portion 88 and the gates of the respective transistors TR1, TR2.

When an abnormality occurs in the transistors TR1, TR2 of a certain signal output circuit 52 due to an influence of the surge and so on, the switching speed of the transistors TR1, TR2 is lowered, so that a suitable transient field cannot be applied to the piezoelectric sheet 141. Where the signal output circuit 52 is thus degraded, the corresponding channel cannot be driven at a high speed, so that the displacement amount of the piezoelectric sheet 141 is reduced, resulting in an insufficient volume of the ink droplet to be ejected from the corresponding nozzle 108. The insufficiency of the ink droplet volume undesirably causes a quality deterioration of the image to be recorded. Further, in each actuator unit 21, the piezoelectric sheets 141-143 may suffer from a crack occurred therein. In this instance, too, the displacement amount of the piezoelectric sheets 141-143 is reduced, causing the insufficiency of the volume of the ink droplet to be ejected from the nozzle 108. Moreover, if the actuator unit 21 continues to be driven with the crack occurred in the piezoelectric sheets 141-143, the crack is enlarged, so that the ink enters the inside of the actuator unit 21 from the pressure chambers 110 through the crack, causing a risk of generating a short circuit in the inside of the actuator unit 21 and the wiring connected thereto.

Referring back to FIG. 7, the inspection portion 89 performs an inspection to judge whether the above-indicted troubles or defects are occurring in the signal output circuits 52*a* and in each actuator unit 21, more specifically, in any of the channels of the actuator unit 21. The inspection is performed on each of the actuator units 21. More specifically described, the inspection portion 89 performs an inspection in which a target of the inspection is each actuator unit 21 (hereinafter the inspection will be referred to as "actuator-unit inspection") and an inspection in which a target of the inspection is each of the channels in one actuator unit (hereinafter the inspection will be referred to as "channel inspection").

Explained in more detail, the signal output circuits 52*a* corresponding to all of the channels in one actuator unit 21 output a charge signal (a first signal) and gives a potential of 24V (a first potential) to all of the corresponding individual electrodes 135. Here, the charge signal is a steady signal for constantly giving the first potential. In a state in which all of the channels are in the charged stated, the inspection portion 89 stores, as a reference current value (a first current value), an electric current value detected by the electric current detecting circuit 90. Where the actuator-unit inspection is performed, namely, where the inspection target is a group of all of the channels in one actuator unit 21, all of the signal output circuits 52*a* corresponding to all of the channels output an inspection signal of a continuous pulse (a second signal) to the individual electrodes 135 which correspond to all of the channels and each of which is an inspection-target electrode. On the other hand, where the channel inspection is performed, namely, where the inspection target is each of the individual channels in one actuator unit 21, one signal output circuit 52*a* corresponding to one inspection-target channel outputs the inspection signal of the continuous pulse to the corresponding individual electrode 135 as the inspection-target electrode while the signal output circuits 52*a* corresponding to the other channels that exclude the above-indicated one inspection-target channel output the above-indicated charge signal to the individual electrodes 135 corresponding to the other channels. In a state in which the inspection signal is being outputted to the above-indicated inspection-target electrode or electrodes, the inspection portion 89 stores, as an inspection current value (a second current value), an electric current value detected by the electric current detecting circuit 90. In this respect, since it is desirable that the electric current value to be detected by the electric current detecting circuit 90 be stabilized, the electric current detecting circuit 90 is configured not to detect the electric current value immediately after the first or the second signal has been outputted, namely, the electric current detecting circuit 90 is configured to detect the electric current in 1 μsec or longer after the output of the first or the second signal. The above-indicated inspection signal of the continuous pulse is for intermittently giving a second potential that is different from the first potential of 24V. The inspection-target channel or channels are continuously driven by the signal being outputted.

When one signal output circuit 52*a* outputs the inspection signal of the continuous pulse to the corresponding inspection-target electrode, the electric current i consumed in the channel corresponding to the inspection-target electrode (hereinafter referred to as "current consumption amount i") is indicated by the following formula:

$$i=FCVn$$

wherein F represents the frequency of the inspection signal, C represents the capacitance of one channel, V represents the drive voltage, and n represents the number of channels being driven. When an abnormality occurs in the transistors TR1, TR2 in the signal output circuit 52*a* and the switching speed of the transistors TR1, TR2 is thereby lowered, the current consumption amount i in the channel in question is reduced. Further, when the crack occurs in the piezoelectric sheets 141-143 or the polarization of the piezoelectric sheet 141 is weakened, the capacitance C of the channel is lowered, resulting in a reduction of the current consumption amount i in the channel in question. Accordingly, when the signal output circuit 52*a* suffers from the abnormality, when the crack occurs the piezoelectric sheets 141-143, or when the polarization of the piezoelectric sheet 141 is weakened, the current consumption amount i becomes smaller than that in the normal state. In these instances, the volume of the ink droplet to be ejected from the corresponding nozzle 108 is decreased.

However, a change in the current consumption amount i in one channel in the abnormal state is infinitesimal, namely, a change in the inspection current value in the abnormal state is infinitesimal. Further, the electric characteristic varies from actuator unit to actuator unit due to production errors. Therefore, calibration of the inspection current value is performed on the basis of the reference current value. More specifically explained, the reference current value is subtracted from the inspection current value, whereby there is calculated a current change amount which represents an electric current amount that has been changed as a result of inputting the inspection signal to the inspection-target individual electrode(s). In this case, the current change amount is a current increase amount which represents an electric current amount that has been increased as a result of inputting of the inspection signal. The thus calculated current change amount is compared with a pre-stored current change amount that has been obtained in advance in the normal state according to the procedure similar to that described above, so as to obtain a current amount difference between the calculated current change amount and the pre-stored current change amount. The current amount difference represents a decrease amount in the current consumption amount i due to the lowered capacitance C or drive voltage V in the channel. Where the current amount difference is not smaller than a threshold, it is judged that there exists an abnormality in association with the channel in question that corresponds to the inspection-target individual electrode, namely, it is judged that there exists an abnormality in the channel per se or the signal output circuit 52*a* corresponding to the channel. As explained later, the inspection procedure according to the present invention is performed on each of the actuator units. Accordingly, the above-indicated pre-stored current change amount is obtained in advance in a state in which there exist no abnormalities in all of the channels and all of the corresponding signal output circuits.

Where the electric current detecting circuit 90 detects a considerably large electric current upon detecting of the above-indicated reference current value or inspection current value, there is a good possibility of a short circuit being occurring in any of the signal output circuits 52*a*, in any of the channels, or between any two adjacent channels. Accordingly, the inspection portion 89 promptly judges that an abnormality due to the short circuit is occurring where the electric current detecting circuit 90 detects a considerably large electric current.

Figure 9A:
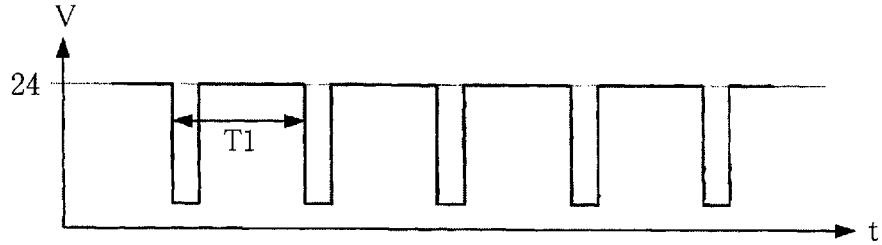
FIGS. 9A and 9B respectively show waveforms of inspection signals.

The inspection signal will be explained with reference to FIGS. 9A and 9B each showing a waveform of the inspection signal outputted from each signal output circuit 52*a*. As shown in FIG. 9A, a pulse period T1 of the inspection signal is shorter than a pulse period T0 of the drive signal for ejecting the ink droplet from each nozzle 108. Further, the inspection signal has a pulse width and a frequency which are set not to eject the ink droplet from the nozzle 108. Accordingly, when the actuator-unit inspection or the channel inspection is performed, the droplet is not ejected from each nozzle 108, obviating wasteful consumption of the ink. In the present embodiment, the frequency of the inspection signal coincides with the resonance frequency inherent to each actuator unit 21. Accordingly, when the resonance frequency inherent to each actuator unit 21 is changed due to the crack occurred in its piezoelectric sheets 141-143, the drive characteristic of the actuator unit 21 is largely varied and the inspection current value is accordingly largely changed. It is therefore possible to easily judge whether the crack occurred in the piezoelectric sheets 141-143.

Figure 9B:
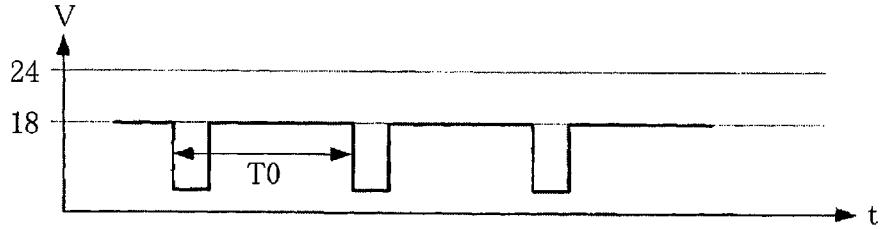

For preventing the ink droplet from being ejected from the nozzle 108, the potential of the signal to be outputted from the signal output circuit 52*a* may be configured to be changeable, as shown in FIG. 9B, and the signal output circuit 52 may be configured to output an inspection signal whose potential is lower than 24V, e.g., 18V, as shown in FIG. 9B, so as to prevent ejection of the ink droplet from the nozzle 108. This arrangement reduces power consumption.

Referring back to FIG. 7, the polarization recovery portion 75 is for permitting the signal output circuits 52*a* to output the charge signal for giving the potential of 24V for a prescribed time period to all of the corresponding individual electrodes 135 belonging to an actuator unit 21 when the inspection portion 89 judges that the actuator unit 21 in question suffers from an abnormality. The processing executed by the polarization recovery portion 75 is referred to as "polarization recovery processing" where appropriate. As a result, the voltage is applied to the piezoelectric sheet 141 constantly for the prescribed time period, thereby recovering the polarization of the piezoelectric sheet 141. The voltage to be applied to the piezoelectric sheet 141 is not limited to 24V. For instance, the potential of the signal to be outputted from the each signal output circuit 52*a* may be changeable into a potential higher than 24V (e.g., 40V), and the signal output circuit 52*a* may be configured to give the potential higher than 24V to the corresponding individual electrode 135. Further, the potential to be given to the common electrode 134 may be changeable from the ground voltage to a negative potential. According to these arrangements, the voltage to be applied to the piezoelectric sheet 141 can be made higher, resulting in efficient recovery of the polarization.

Figure 10A:
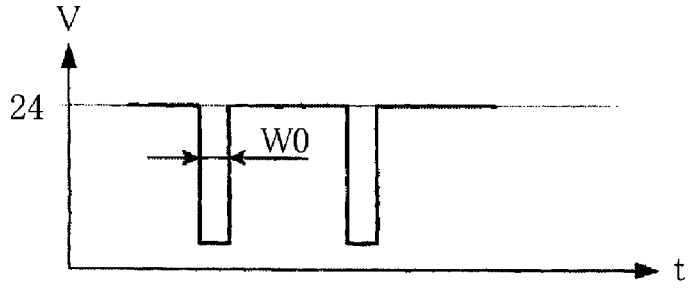
FIG. 10A shows a waveform of a drive signal in a normal state and FIG. 10B shows a waveform of the drive signal whose pulse width is adjusted by a pulse-width adjusting portion shown in FIG. 7.
Figure 10B:
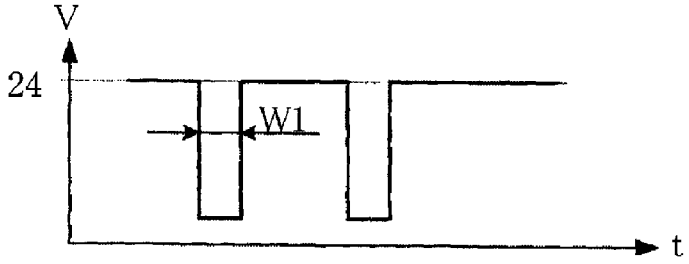

With reference to FIGS. 7 and 10, the pulse-width adjusting portion 76 will be explained. FIGS. 10A and 10B are views for explaining an operation of the pulse-width adjusting portion 76. The pulse-width adjusting portion 76 is for adjusting the pulse width of the drive signal to be outputted from each signal output circuit 52*a*, on the basis of the inspection or judgment result made by the inspection portion 89. More specifically explained, when the inspection portion 89 judges that a certain channel suffers from an abnormality and that the volume of the ink droplet to be ejected from the nozzle 108 corresponding to that channel is insufficient, the pulse-width adjusting portion 76 adjusts the drive signal to be outputted from the corresponding signal output circuit 52*a* so as to increase the volume of the ink droplet to be outputted from the nozzle 108.

As shown in FIG. 10A, in the normal state, the pulse width of the drive signal for ejecting the ink droplet is equal to W0 that is slightly shorter than the acoustic length AL. Where it is judged that the volume of the ink droplet to be ejected from the nozzle 108 corresponding to the channel in question is insufficient, the pulse-width adjusting portion 76 adjusts the pulse width of the drive signal to W1 that is longer than W0, so as to be close to AL. By making the pulse width close to AL, the pressure generated upon the volume decrease is efficiently added upon changing from the negative pressure state to the positive pressure state, whereby the ink droplet can be ejected by a stronger pressure from the nozzle 108. Accordingly, even when the drive force of the channel is lowered, the volume of the ink droplet to be ejected from the corresponding nozzle 108 is prevented from being decreased.

Figure 11A:
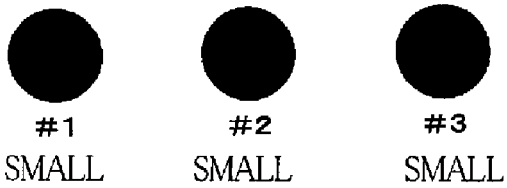
FIG. 11 is a view for explaining an operation of an image-data modifying portion shown in FIG. 7.
Figure 11B:
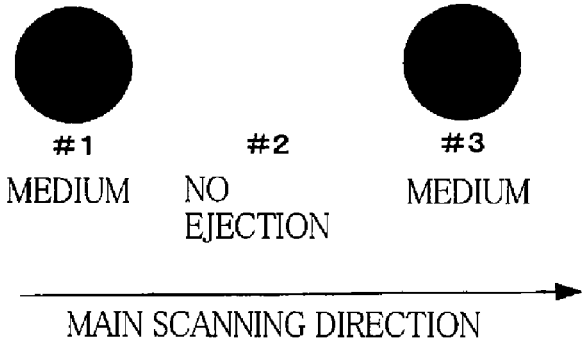

With reference to FIGS. 7 and 11, the image-data modifying portion 77 will be explained. The image-data modifying portion 77 is for modifying dot data indicative of the amount or volume of the ink to be ejected from each nozzle 108, on the basis of the inspection or judgment result made by the inspection portion 89. Where the inspection portion 89 judges that a certain channel suffers from an abnormality and that the nozzle 108 corresponding to that abnormal channel suffers from an ejection failure, the image-data modifying portion 77 modifies dot data which is stored in the image-data storing portion 87 in conjunction with the nozzles adjacent to the defective nozzle 108 suffering from the ejection failure, such that the dot data indicates a larger ink droplet. The target of modification by the image-data modifying portion 77 is dot data in conjunction with two nozzles 108 located on opposite sides of the defective nozzle 108 in the main scanning direction The modifying operation by the image-data modifying portion 77 will be explained in detail with reference to FIGS. 11A and 11B. As shown in FIG. 11A, before modification, all of dot data corresponding to respective three dots #1, #2, #3 arranged in the main scanning direction indicate that each of the three dots #1, #2, #3 is formed by the ink droplet whose volume is "small". Where the inspection portion 89 judges that the ink droplet cannot be ejected from the nozzle 108 that corresponds to the channel relating to the dot #2, the image-data modifying portion 77 modifies the dot data corresponding to the dots #1 and #3 located on the opposite sides of the dot #2 in the main scanning direction, such that the dot data indicates that each of the two dots #1 and #3 is formed by the ink droplet whose volume is "medium" or "large". FIG. 11B shows an instance where the dot data is modified so as to indicate the ink droplet volume "medium" changed from "small". That is, the image-data modifying portion 77 modifies the dot data corresponding to the respective dots #1 and #3 such that the volume of the ink droplet to be ejected from the two nozzles 108 for respectively forming the two dots #1 and #3 becomes larger. According to the arrangement, even if the ink droplet is not ejected from the nozzle 108 corresponding to the abnormal channel, the volume of the ink droplets to be ejected from the respective two nozzles 108 located on the opposite sides of that nozzle in the main scanning direction is increased, whereby the image quality can be prevented from being deteriorated.

Figure 12:
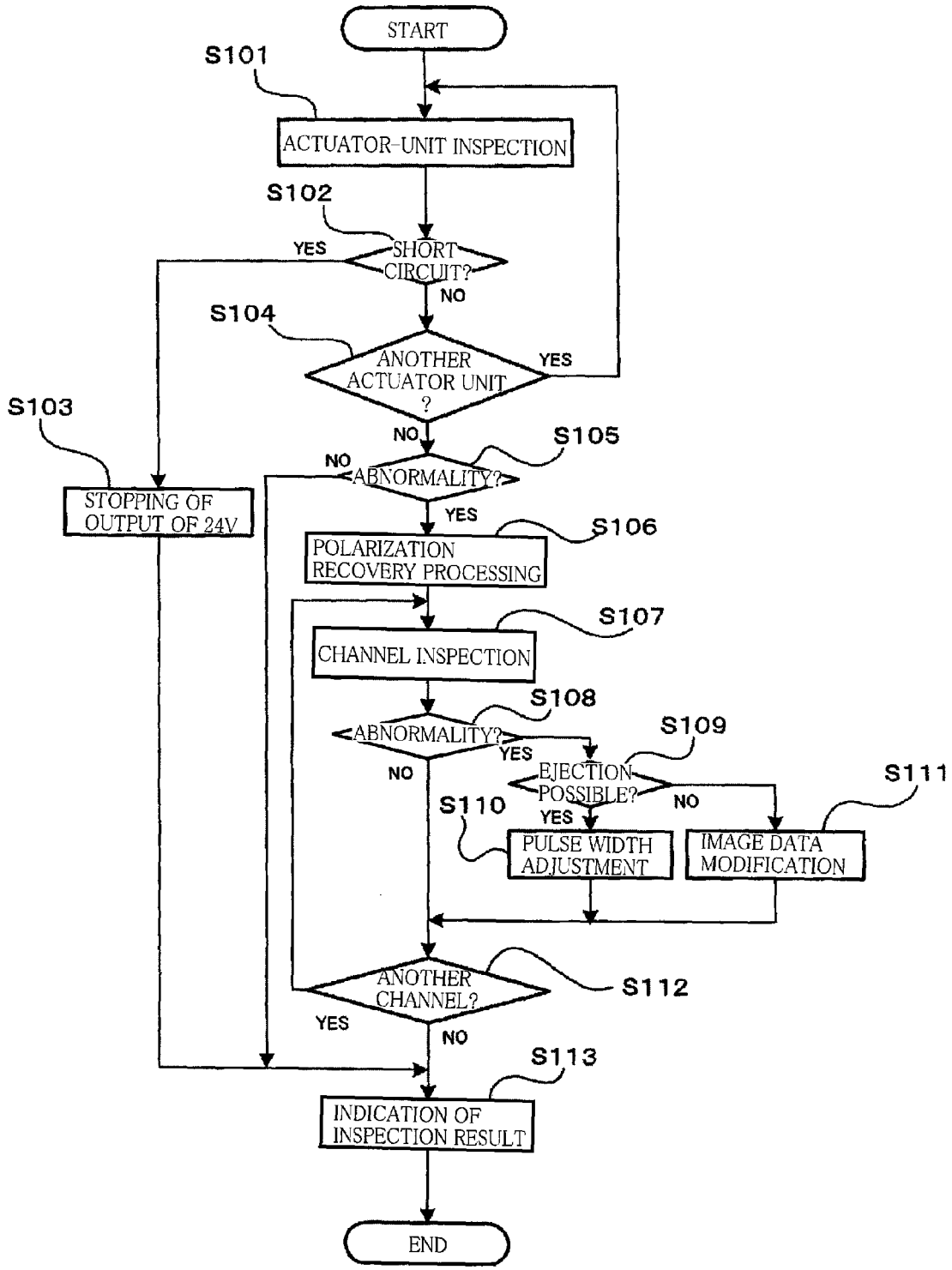
FIG. 12 is a flow chart showing an inspection procedure of the ink-jet head shown in FIG. 1.

Referring next to the flow chart of FIG. 12, there will be explained an inspection procedure of the ink-jet head 1. The inspection of the ink-jet head 1 is executable on an occasion such as upon startup of the ink-jet printer 101, prior to or during printing, upon completion of printing, upon purging for discharging the ink from the nozzles 108, or upon inputting of a user's command. As shown in FIG. 12, when the inspection of the ink-jet head 1 is initiated, step S101 (hereinafter "step" is omitted where appropriate) is implemented in which the inspection portion 89 performs the above-indicated actuator-unit inspection on the actuator units 21 in order one actuator unit by one actuator unit, each as the inspection target. That is, the inspection portion 89 performs the inspection on each actuator unit 21 and the signal output circuits 52*a* (the driver IC 52) corresponding to the actuator unit 21. S101 will be explained in detail with reference to FIG. 13.

S101 is followed by S102 to judge whether a short circuit in association with the inspection-target actuator unit is occurring or not. Where it is judged that the short circuit is occurring (S102: YES), S103 is implemented to stop the output of the 24V-system electric power from the power supply device 85. Thereafter, the control flow goes to S113 to indicate the inspection result on a display (not shown), and one execution of the routine of the flow chart of FIG. 12 is ended. On the other hand, where it is judged that no short circuits are occurring (S102: NO), S104 is implemented to judge whether there exists another actuator unit to be inspected. Where there exists another actuator unit 21 to be inspected (S104: YES), the control flow goes back to S101 to repeat the above-indicated processing. On the other hand, where it is judged that there exist no actuator units 21 to be inspected (S104: NO), S105 is implemented to judge whether there has been an abnormality in association with at least any of the actuator units 21. Where there have been no abnormalities in all of the actuator units 21 (S105: NO), the control flow goes to S113 to indicate the inspection result on the display (not shown) and one execution of the routine of the flow chart of FIG. 12 is ended. Where it is judged that there has been an abnormality in any of the actuator units 21 (S105: YES), on the other hand, S106 is implemented.

In S106, the polarization recovery portion 75 performs the above-indicated polarization recovery processing in which the polarization recovery portion 75 permits the signal output circuits 52*a* to output the charge signal for giving the potential of 24V for the prescribed time period to all of the corresponding individual electrodes 135 in association with the actuator unit 21 suffering from the abnormality. In this respect, the inspection portion 89 cannot judge whether or not the abnormality in the actuator unit 21 is due to lowered polarization of the piezoelectric sheet 141. Accordingly, the polarization recovery processing indicated above is performed on all of the actuator units 21 that have been judged to suffer from the abnormality. Thereafter, S107 is implemented.

In S107, the inspection portion 89 performs the above-indicated channel inspection on each of the channels in the actuator unit 21 that has been judged to suffer from the abnormality, in order one channel by one channel each as the inspection target, whereby each channel and the corresponding signal output circuit 52*a* are inspected. It is noted the processing in S107 is substantially the same as the processing in S101 except that the inspection target in S107 is one channel in the abnormal actuator unit 21. Therefore, the processing in S107 will be explained in detail with reference to FIG. 13, together with the processing in S101. S107 is followed by S108 to judge whether there has been an abnormality in the inspection target channel. Where it is judged that there has been an abnormality in the inspection-target channel (S108: YES), S109 is implemented to judge whether the ink droplet can be ejected from the nozzle 108 corresponding to the inspection-target channel.

The judgment in S109 is made by the inspection portion 89 on the basis of the above-described current amount difference calculated for the channel in question. More specifically explained, when the current change amount is larger than a threshold, it is judged that the ink droplet cannot be ejected even if the channel is driven. On the other hand, when the current change amount is less than the threshold, it is judged that the ink droplet can be ejected by driving the channel although the volume of the ink droplet is insufficient as compared with the volume in the normal state. Where it is judged that the ink droplet can be ejected (S109: YES), S110 is implemented in which the pulse-width adjusting portion 76 adjusts the pulse width of the drive signal to be outputted from the signal output circuit 52*a* that corresponds to the channel in question. On the other hand, where it is judged that the ink droplet cannot be ejected (S109: NO), S111 is implemented in which the image-data modifying portion 77 modifies dot data corresponding to the channel among dot data stored in the image-data storing portion 87. Thereafter, S112 is implemented.

On the other hand, where it is judged that no abnormalities are found in the inspection-target channel (S108: NO), S112 is implemented to judge whether there exists another channel to be inspected. Where there exists another channel to be inspected (S112: YES), the control flow goes back to S107 to repeat the above-described processing. Where there exist no channels to be inspected (S112: NO), S113 is implemented to indicate the inspection result on the display (not shown), and one execution of the routine of the flow chart of FIG. 12 is ended.

Figure 13:
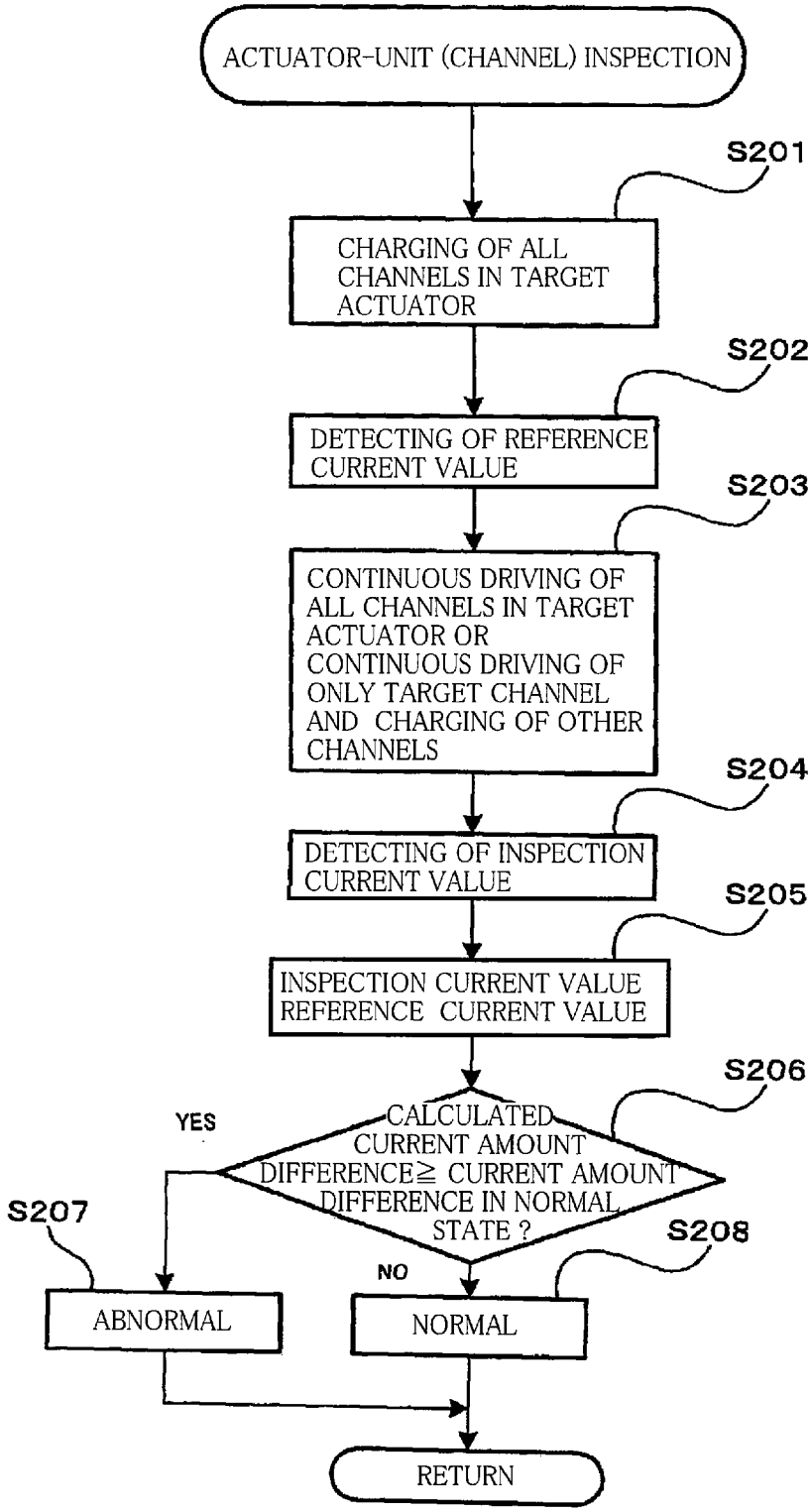
FIG. 13 is a flow chart showing an actuator-unit (channel) inspection procedure.

Referring next to the flow chart of FIG. 13, the inspection of the actuator unit 21 in S101 and the inspection of the channel performed in S107 in the flow chart of FIG. 12 will be explained. The flow chart of FIG. 13 indicates the inspection procedure of the actuator unit 21 or the channel. Initially, S201 is implemented in which the signal output circuits 52*a* corresponding to all of the channels in one actuator unit 21 output the charge signal to all of the individual electrodes 135 corresponding to all of the channels, whereby all of the channels are charged. S201 is followed by S202 in which the electric current detecting circuit 90 detects, as the reference current value, an electric current value in a state in which all of the channels are charged. Thereafter, S203 is implemented.

In S203, where the above-indicated actuator-unit inspection is performed, namely, where a group of all of the channels in one actuator unit 21 is the inspection target, the signal output circuits 52*a* corresponding to all of the channels output the above-indicated inspection signal to all of the individual electrodes 135 corresponding to all of the channels, each as the inspection-target electrode. In S203, where the above-indicated channel inspection is performed, namely, where each of the individual channels in one actuator unit 21 is the inspection target, one signal output circuit 52*a* corresponding to one channel as the inspection target outputs the inspection signal to one corresponding individual electrode 135 as the inspection-target electrode while, at the same time, the rest of the signal output circuits 52*a* except the above-indicated one signal output circuit 52*a* corresponding to the above-indicated one channel as the inspection target output the charge signal to the corresponding individual electrodes 135. S203 is followed by S204 in which the electric current detecting circuit 90 detects, as the inspection current value, an electric current value in the state indicated above. Thereafter, the control flow goes to S205.

In S205, the reference current value is subtracted from the inspection current value, whereby there is calculated a current change amount which represents an electric current amount that has been changed as a result of inputting the inspection signal to the inspection-target individual electrode(s). Subsequently, in S206, the thus calculated current change amount is compared with a pre-stored current change amount that has been obtained in advance in the normal state according to a procedure similar to that described above, so as to obtain a current amount difference between the calculated current change amount and the pre-stored current change amount. Further, it is judged whether the obtained current amount difference is not smaller than a threshold. Where it is judged that the current amount difference is not smaller than the threshold (S206:YES), the control flow goes to S207 in which it is judged that there exists an abnormality in association with any of the plurality channels when a group of the plurality of channels is the inspection target or it is judged that there exists an abnormality in association with one channel when one channel is the inspection target. Thus, one execution of the routine of the flow chart of FIG. 13 is ended. On the other hand, where it is judged that the current amount difference is smaller than the threshold (S206: NO), S208 is implemented in which it is judged that one or plurality of channels each as the inspection target and the corresponding one or plurality of signal output circuits 52*a* are normal. Thus, one execution of the routine of the flow chart of FIG. 13 is ended.

In the illustrated embodiment, the current change amount which represents an electric current amount that has been changed as a result of inputting the inspection signal to the inspection-target individual electrode(s) is calculated by subtracting the reference current value from the inspection current value. On the basis of the thus calculated current amount difference, it is possible to judge the abnormality in association with one channel or any of the plurality of channels in one actuator unit 21 or the abnormality in association with one signal output circuit 52*a* corresponding to the one channel or any of the plurality of signal output circuits 52*a* corresponding to any of the plurality of channels. Such an abnormality can be judged without providing the electric detecting circuit 90 for each of the channels. Accordingly, the present ink-jet printer 101 enjoys a size reduction and a low manufacturing cost.

Since the frequency of the inspection signal coincides with the resonance frequency inherent to each actuator unit 21, the drive characteristic of the actuator unit 21 largely changes and the inspection current value also largely changes when the resonance frequency changes due to the crack occurred in the piezoelectric sheets 141-143. Accordingly, it is possible to easily judge whether the crack occurs in the piezoelectric sheets 141-143.

In the illustrated embodiment, when the inspection portion 89 judges that there exists an abnormality in one actuator unit 21, the polarization recovery portion 75 permits the charge signal to be inputted to all of the individual electrodes 135 in the actuator unit 21 suffering from the abnormality. As a result, the voltage is applied to the piezoelectric sheet 141 constantly for the prescribed time period, thereby recovering the polarization of the piezoelectric sheet 141.

Further, when the inspection portion 89 judges that there exists an abnormality in a certain channel and therefore the volume of the ink droplet to be ejected from the nozzle 108 corresponding to the abnormal channel is insufficient, the pulse-width adjusting portion 76 adjusts the pulse width of the drive signal which is for ejecting the ink droplet and which is to be outputted from the corresponding signal output circuit 52*a*, such that the volume of the ink droplet is increased. Accordingly, the volume of the ink droplet to be ejected from the corresponding nozzle 108 is prevented from being decreased when the drive force of the channel is decreased.

In addition, when the inspection portion 89 judges that there exists an abnormality in a certain channel and therefore the ink droplet cannot be ejected from the nozzles 108 corresponding to the abnormal channel, the image-data modifying portion 77 modifies the dot data included in the image data and indicative of the volume of the ink to be ejected from the two nozzles 108 located, in the main scanning direction, on the opposite sides of the nozzle 108 corresponding to the abnormal channel, into the dot data indicative of a larger ink volume. Accordingly, even when the ink droplet is not ejected from the nozzle 108 corresponding to the abnormal channel, the volume of the ink ejected from the two nozzles 108 located adjacent to the nozzle 108 in question in the main scanning direction is increased, so as to prevent a deterioration of the image quality.

Second Embodiment

There will be next explained an ink-jet printer according to a second embodiment of the invention. The ink-jet printer according to the second embodiment differs from the ink-jet printer according to the illustrated first embodiment only in the operation of the inspection portion, and other functional portions and devices in the second embodiment are substantially the same as the illustrated first embodiment. Accordingly, only the inspection portion will be explained in detail, and an explanation of other functional portions and devices indicated by the same reference numerals as in the first embodiment is omitted.

In each signal output circuit 52*a*, the transistors TR1, TR2, the protective diodes D1, D2, etc., are degraded due to the latchup of the transistors TR1, TR2, the surge as a result of electrostatic discharge, etc. Where the transistor TR1 or the diode D1 is degraded, for instance, there is a possibility that a leak current flows between the source and the drain of the transistor TR1 or in the protective diode D1. Heat generated by the leak current may break the signal output circuit 52*a*.

The inspection portion in the second embodiment is for performing an inspection to judge whether an abnormality is occurring in any of the signal output circuits 52*a* and in any of the actuator units 21, more specifically, in any of the channels constituting one actuator unit 21. Explained more specifically, the inspection portion in the second embodiment is configured to perform an inspection mainly to judge whether the above-indicated troubles or defects are occurring in any of the signal output circuits 52*a*. Explained in more detail, the signal output circuits 52*a* corresponding to all of the channels in one actuator unit 21 output a charge signal (a first signal) and gives a potential of 24V (a first potential) to all of the corresponding individual electrodes 135. In a state in which all of the channels are in the charged stated, the inspection portion 89 stores, as a reference current value (a first current value), an electric current value detected by the electric current detecting circuit 90. Where the inspection target is a group of all of the channels in one actuator unit 21, all of the signal output circuits 52*a* corresponding to all of the channels output a discharge signal (a second signal) to the individual electrodes 135 which correspond to all of the channels and each of which is an inspection-target electrode, so as to give a ground potential (a second potential) to the same 135. Here, the discharge signal is a steady signal for constantly giving the second potential. On the other hand, where the inspection target is each of the individual channels in one actuator unit 21, the signal output circuit 52*a* corresponding to one inspection-target channel outputs the above-described discharge signal to the corresponding individual electrode 135 as the inspection-target electrode while the signal output circuits 52*a* corresponding to the other channels that exclude the above-indicated one inspection-target channel output the above-described charge signal to the individual electrodes 135 corresponding to the other channels. In a sate in which the discharge signal is being outputted to the above-indicated inspection-target electrode or electrodes, the inspection portion 89 stores, as an inspection current value (a second current value), an electric current value detected by the electric current detecting circuit 90.

It is noted that a change in the inspection current value due to the generation of the leak current in each signal output circuit 52*a* is infinitesimal. Further, the characteristic varies from actuator unit to actuator unit due to production errors. Therefore, calibration of the inspection current value is performed on the basis of the reference current value. More specifically explained, the reference current value is subtracted from the inspection current value, whereby there is calculated a current change amount which represents an electric current amount that has been changed as a result of outputting the discharge signal to the inspection-target individual electrode(s). The thus calculated current change amount is compared with a pre-stored current change amount that has been obtained in advance in the normal state according to a procedure similar to that described above, so as to obtain a current amount difference between the calculated current change amount and the pre-stored current change amount. The current amount difference is an electric current component which arises from the leak current. Where the current amount difference is not smaller than a threshold, it is judged that there exists an abnormality in one signal output circuit 52*a* corresponding to one inspection-target channel or in any of the plurality of signal output circuits 52*a* corresponding to any of the plurality of inspection-target channels. In short, it is judged that the above-indicated troubles or defects are occurring when the current change amount which represents a current amount that has been changed by an amount corresponding to the leak current is lager than a prescribed value.

Figure 14:
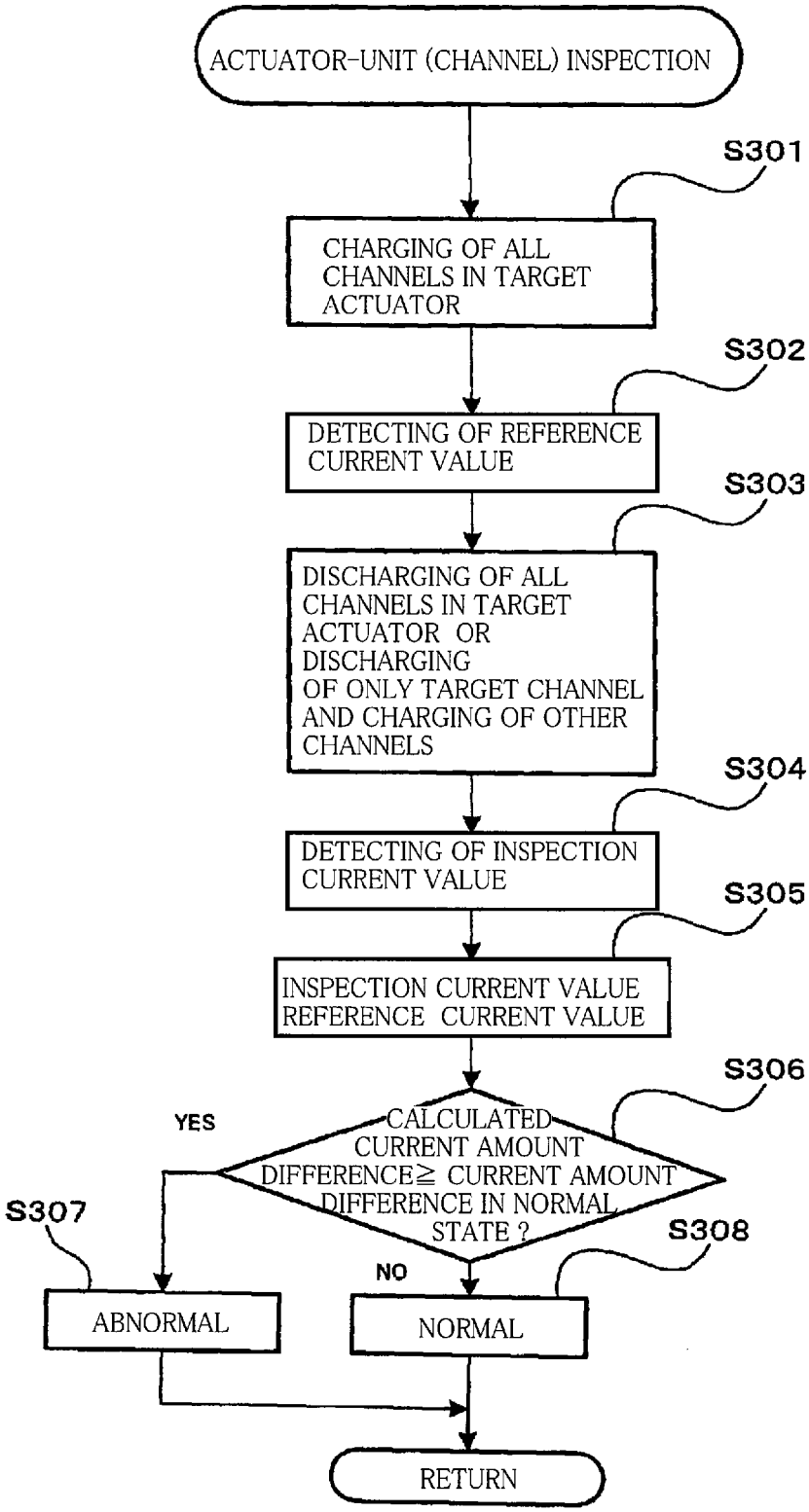
FIG. 14 is a flow chart showing an actuator-unit (channel) inspection procedure according to a second embodiment.

Referring next to the flow chart of FIG. 14, there will be explained an inspection procedure of the ink-jet head 1. The inspection procedure in the second embodiment is substantially the same as the inspection procedure indicated in the flow chart of FIG. 12 in the illustrated first embodiment, except the details of the actuator-unit inspection (S101) and the channel inspection (S107). Accordingly, only the actuator-unit inspection and the channel inspection will be explained. The flow chart of FIG. 14 shows the actuator-unit inspection procedure and the channel inspection procedure.

In the actuator-unit inspection and the channel inspection, S301 is initially implemented in which the signal output circuits 52*a* corresponding to all of the channels in one actuator unit 21 output the charge signal for giving the potential of 24V to all of the corresponding individual electrodes 135, whereby all of the channels in that one actuator unit 21 are charged. Subsequently, S302 is implemented in which the electric detecting circuit 90 detects, as the reference current value, an electric current value in a state in which all of the channels are charged. Thereafter, S303 is implemented.

In S303, where the above-indicated actuator-unit inspection is performed, namely, where a group of all of the channels in one actuator unit 21 is the inspection target, the signal output circuits 52*a* corresponding to all of the channels output the above-indicated discharge signal to all of the individual electrodes 135 corresponding to all of the channels, each as the inspection-target electrode. In S303, where the above-indicated channel inspection is performed, namely, where each of the individual channels in one actuator unit 21 is the inspection target, one signal output circuit 52*a* corresponding to one channel as the inspection target outputs the discharge signal to one corresponding individual electrode 135 as the inspection-target electrode while, at the same time, the rest of the signal output circuits 52*a* except the above-indicated one signal output circuit 52*a* corresponding to the above-indicated one channel as the inspection target output the charge signal to the corresponding individual electrodes 135. S303 is followed by S304 in which the electric current detecting circuit 90 detects, as the inspection current value, an electric current in the state indicated above. Thereafter, the control flow goes to S305.

In S305, the reference current value is subtracted from the inspection current value, whereby there is calculated a current change amount which represents an electric current amount that has been changed as a result of inputting the discharge signal to the inspection-target individual electrode(s). Subsequently in S306, the thus calculated current change amount is compared with a pre-stored current change amount that has been obtained in advance in the normal state according to a procedure similar to that described above, so as to obtain a current amount difference between the calculated current change amount and the pre-stored current change amount. Further, it is judged whether the obtained current amount difference is not smaller than a threshold. Where it is judged that the current amount difference is not smaller than the threshold (S306: YES), the control flow goes to S307 in which it is judged that there exists an abnormality in association with any of the plurality of channels when a group of the plurality of channels is the inspection target or it is judged that there exists an abnormality in association with one channel when one channel is the inspection target. Thus, one execution of the routine of the flow chart of FIG. 14 is ended. On the other hand, where it is judged that the current amount difference is smaller than the threshold (S306: NO), S308 is implemented in which it is judged that one or plurality of channels each as the inspection target and the corresponding one or plurality of signal output circuits 52*a* are normal. Thus, one execution of the routine of the flow chart of FIG. 14 is ended.

After the judgment of normality or abnormality in the actuator-unit inspection or the channel inspection has been completed, the polarization recovery processing, the pulse-width adjustment processing, and the image-data modification processing explained in the illustrated first embodiment are performed. Each processing is performed according to the flow chart of FIG. 12.

In the second embodiment, the inspection is performed mainly to judge whether the above-indicated troubles or defects are occurring in any of the signal output circuits 52*a*. Accordingly, the judgment as to whether an abnormality in association with a certain channel is occurring or not is made by taking account of a small leak current due to degradation of the transistors TR1, TR2 and the diodes D1, D2. Due to the leak current, the charge and discharge current is decreased or the rise time or the fall time of the drive signal becomes longer. Accordingly, in the actuator-unit inspection and channel inspection, the above-described thresholds used for the judgment based on the current amount difference are respectively set such that the abnormality judgment is made when there is generated the leak current which is equal to or larger than 10% with respect to the peak current of the charge and discharge current in the normal state. The inspection portion 89 judges based on the thus set thresholds.

The judgment in S109 in the second embodiment, namely, the judgment as to whether the ink droplet cannot be ejected even if a certain channel is driven, is made by taking account of a relatively large leak current due to degradation of the transistors TR1, TR2 and the diodes D1, D2. Accordingly, in the channel inspection, a threshold used for the judgment based on the current amount difference is set such that the ejection-failure judgment is made when there is generated the leak current which is equal to or larger than 50% with respect to the peak current of the charge and discharge current in the normal state. The inspection portion 89 makes the judgment in S109 based on the thus set threshold. Where a certain channel is judged to suffer from ejection failure, the signal output circuit 52*a* corresponding to that channel is determined to be out of order and the channel is stopped to be driven, thereby obviating a critical damage to the driver IC 52.

In the second embodiment illustrated above, the current change amount which represents an electric current amount that has been changed as a result of inputting the discharge signal to the inspection-target individual electrode(s) is calculated by subtracting the reference current value from the inspection current value. On the basis of the thus calculated current amount difference, it is possible to judge the abnormality in association with the signal output circuits 52*a* and so on. Accordingly, the abnormality in association with the signal output circuits 52*a* and so on can be judged without providing the electric current detecting circuit 90 for each of the channels. Thus, the present ink-jet printer 101 enjoys a size reduction and a low manufacturing cost.

Modified Embodiments

While the preferred embodiments of the invention have been described by reference to the accompanying drawings, for illustrative purpose only, it is to be understood that the present invention is not limited to the details of the illustrated embodiments, but may be embodied with various changes and modifications, which may occur to those skilled in the art, without departing from the spirit and scope of the invention defined in the attached claims.

In the illustrated first embodiment, the signal output circuits 52*a* corresponding to all of the channels in one actuator unit 21 output the charge signal to all of the individual electrodes 135 corresponding to all of the channels, whereby all of the channels are charged. The electric current value detected by the electric current detecting circuit 90 when all of the channels are charged is stored as the reference current value. In a case where the inspection target is a group of all of the channels in one actuator unit 21, all of the signal output circuits 52*a* corresponding to all of the channels output the inspection signal to all of the individual electrodes 135 corresponding to all of the channels, each as the inspection-target electrode. In a case where the inspection target is each of the individual channels in one actuator unit 21, the signal output circuit 52*a* corresponding to one channel as the inspection target outputs the inspection signal to one individual electrode 135 as the inspection-target electrode while, at the same time, the signal output circuits 52*a* corresponding to the rest of the channels expect the inspection-target channel output the charge signal to the corresponding individual electrodes 135. In a state in which the inspection signal is being outputted to the one or plurality of individual electrodes 135, the inspection portion 89 stores, as the inspection current value, the electric current value detected by the electric current detecting circuit 90. The inspection portion 89 is configured to execute the processing described above.

Instead, the inspection portion 89 may be configured to execute the following processing. Initially, the signal output circuits 52*a* corresponding to all of the channels in one actuator unit 21 output the discharge signal to all of the individual electrodes 135 corresponding to all of the channels, whereby all of the channels are discharged. The electric current value detected by the electric current detecting circuit 90 when all of the channels are discharged is stored as the reference current value. In a case where the inspection target is a group of all of the channels in one actuator unit 21, all of the output circuits 52*a* corresponding to all of the channels output the inspection signal to all of the individual electrodes 135 corresponding to all of the channels, each as the inspection-target electrode. In a case where the inspection target is each of the individual channels in one actuator unit 21, the signal output circuit 52*a* corresponding to one channel as the inspection target outputs the inspection signal to one individual electrode 135 as the inspection-target electrode while, at the same time, the signal output circuits 52*a* corresponding to the rest of the channels expect the inspection-target channel output the discharge signal to the corresponding individual electrodes 135. In a state in which the inspection signal is being outputted to the one or plurality of individual electrodes 135, the inspection portion 89 stores, as the inspection current value, the electric current value detected by the electric current detecting circuit 90. In this instance, the inspection signal may be set as a pulse signal for intermittently giving the second potential that is different from the ground potential as the first potential.

In the illustrated second embodiment, the signal output circuits 52*a* corresponding to all of the channels in one actuator unit 21 output the charge signal to all of the individual electrodes 135 corresponding to all of the channels, whereby all of the channels are charged. The electric current value detected by the electric current detecting circuit 90 when all of the channels are charged is stored as the reference current value. In a case where the inspection target is a group of all of the channels in one actuator unit 21, all of the signal output circuits 52*a* corresponding to all of the channels output the discharge signal to all of the individual electrodes 135 corresponding to all of the channels, each as the inspection-target electrode. In a case where the inspection target is each of the individual channels in one actuator unit 21, the signal output circuit 52*a* corresponding to one channel as the inspection target outputs the discharge signal to one individual electrode as the inspection-target electrode while, at the same time, the signal output circuits 52*a* corresponding to the rest of the channels expect the inspection-target channel output the charge signal to the corresponding individual electrodes 135. In a state in which the discharge signal is being outputted to the one or plurality of individual electrodes 135, the inspection portion 89 stores, as the inspection current value, the electric current value detected by the electric current detecting circuit 90. The inspection portion 89 is configured to execute the processing described above.

Instead, the inspection portion 89 may be configured to execute the following processing. Initially, the signal output circuits 52*a* corresponding to all of the channels in one actuator unit 21 output the discharge signal to all of the individual electrodes 135 corresponding to all of the channels, whereby all of the channels are discharged. The electric current value detected by the electric current detecting circuit 90 when all of the channels are discharged is stored as the reference current value. In a case where the inspection target is a group of all of the channels in one actuator unit 21, all of the signal output circuits 52*a* corresponding to all of the channels output the charge signal to all of the individual electrodes 135 corresponding to all of the channels, each as the inspection-target electrode. In a case where the inspection target is each of the individual channels in one actuator unit 21, the signal output circuit 52*a* corresponding to one channel as the inspection target outputs the charge signal to one individual electrode 135 as the inspection-target electrode while, at the same time, the signal output circuits 52*a* corresponding to the rest of the channels expect the inspection-target channel output the discharge signal to the corresponding individual electrodes 135. In a state in which the charge signal is being outputted to the one or plurality of individual electrodes 135, the inspection portion 89 stores, as the inspection current value, the electric current detected by the electric current detecting circuit 90.

In the illustrated embodiments, after the actuator-unit inspection has been performed on each actuator unit 21, the channel inspection is performed on each of the individual channels of the actuator unit 21 that has been judged to suffer from an abnormality. Only the actuator-unit inspection or only the channel inspection may be performed. The channel inspection may be performed on a group of the plurality of channels as the inspection target.

In the illustrated embodiments, the frequency of the inspection signal coincides with the resonance frequency inherent to each actuator unit 21. The frequency of the inspection signal may not coincide with the resonance frequency inherent to each actuator unit 21.

In the illustrated embodiments, when the inspection portion 89 judges that there exists an abnormality in a certain actuator unit 21, the polarization recovery portion 75 permits the signal output circuits 52*a* to output, for the prescribed time period, the charge signal for giving the potential of 24V to all of the individual electrodes 135 for that abnormal actuator unit 21. The polarization recovery portion 75 may be configured to permit the signal output circuits 52*a* to output the charge signal to all of the individual electrodes 135 repeatedly each time when a prescribed time elapses. Alternatively, the polarization recovery processing may not be performed.

In the illustrated embodiments, the recovery processing by the polarization recovery portion 75 is performed for each of the actuator units 21 after the actuator-unit inspection has been performed thereon. The recovery processing may be performed after the judgment as to the presence or absence of abnormality in the channel inspection in S106 has been made. In this instance, the polarization recovery processing in S106 is not performed. Instead, in place of or in addition to the pulse-width adjustment processing in S110, for instance, the polarization recovery processing may be performed. The arrangement makes it possible to perform the recovery processing only on the channel that has been judged to be abnormal, contributing to downsizing of the device for performing the recovery processing.

In the illustrated embodiments, when the inspection portion 89 judges that there exists an abnormality in association with a certain channel and that the volume of the ink droplet to be ejected from the nozzle 108 corresponding to that abnormal channel is insufficient, the pulse-width adjusting portion 76 adjusts the pulse width of the drive signal for ejecting the ink droplet that is to be outputted from the signal output circuit 52*a* corresponding to the abnormal channel, such that the volume of the ink droplet to be ejected from the corresponding nozzle 108 is increased. Alternatively, the pulse width may not be adjusted.

In the illustrated embodiments, when the inspection portion 89 judges that there exists an abnormality in association with a certain channel and that the ink droplet cannot be ejected from the nozzle 108 corresponding to that abnormal channel, the image-data modifying portion 77 modifies the dot data included in the image data and indicative of the volume of the ink to be ejected from the two nozzles 108 located, in the main scanning direction, on the opposite sides of the nozzle 108 corresponding to that abnormal channel, into the dot data indicative of a larger ink volume. The dot data to be modified may be dot data relating to at least any of dots to be disposed around the dot corresponding to the abnormal channel. Alternatively, the dot data may not be modified.

What is claimed is:

1. An ink jet recording apparatus, comprising:

a flow-passage unit including a plurality of pressure chambers, a plurality of nozzles provided so as to respectively correspond to the plurality of pressure chambers, and a plurality of individual ink passages through which the plurality of pressure chambers respectively communicate with the plurality of nozzles;

a plurality of actuators including a plurality of individual electrodes provided so as to respectively correspond to the plurality of pressure chambers, a ground electrode which is disposed so as to face to the plurality of individual electrodes and to which a base potential is given, and a piezoelectric layer interposed between the plurality of individual electrodes and the ground electrode;

a plurality of signal output circuits which are provided so as to respectively correspond to the plurality of actuators and each of which outputs a signal for giving a potential to a corresponding one of the plurality of individual electrodes;

a power supply device which supplies, to the plurality of signal output circuits, an electric power for giving the potential to the plurality of individual electrodes;

an electric current detecting device which detects an electric current with respect to the electric power supplied by the power supply device; and a control device which executes a control of the ink jet recording apparatus and which includes an abnormality judging portion which judges that there exists an abnormality among (a) at least one of the plurality of signal output circuits which corresponds to at least one test-target individual electrode that is at least a part of the plurality of individual electrodes and (b) at least one of the plurality of actuators which corresponds to the at least one test-target individual electrode, on the basis of a current change amount that is a difference between a first current value and a second current value, the first current value being detected by the electric current detecting device when each of the plurality of signal output circuits outputs a first signal for giving a first potential and the second current value being detected by the electric current detecting device when each of the at least one of the plurality of signal output circuits outputs a second signal for giving a second potential different from the first potential while each of the rest of the plurality of signal output circuits which excludes the at least one of the plurality of signal output circuits output the first signal.

2. The ink jet recording apparatus according to claim 1, wherein the abnormality judging portion is configured to judge that there exists the abnormality among (a) the at least one of the plurality of signal output circuits and (b) the at least one of the plurality of actuators, when a difference between the current change amount obtained based on detection of the first and second current values by the electric current detecting device and the current change amount to be obtained when there exists no abnormality among the plurality of signal output circuits and the plurality of actuators is larger than a threshold.

3. The ink jet recording apparatus according to claim 1, wherein the abnormality judging portion is configured to judge that there exists the abnormality among (a) the at least one of the plurality of signal output circuits and (b) the at least one of the plurality of actuators, when the current change amount obtained based on detection of the first and second current values by the electric current detecting device is larger than a prescribed value.

4. The ink jet recording apparatus according to claim 1, wherein one of the first potential and the second potential is the base potential and the other of the first potential and the second potential is a drive potential for driving each of the plurality of actuators.

5. The ink jet recording apparatus according to claim 1, wherein the first signal and the second signal are respective steady signals for constantly giving the first potential and the second potential, respectively.

6. The ink jet recording apparatus according to claim 1, wherein the first signal is a steady signal for constantly giving the first potential while the second signal is a pulse signal for intermittently giving the second potential.

7. The ink jet recording apparatus according to claim 6, wherein a frequency of a pulse of the second signal is equal to a resonance frequency inherent to the plurality of actuators.

8. The ink jet recording apparatus according to claim 6, wherein a frequency of a pulse of the second signal is set such that, even when the second signal is outputted to each of the plurality of actuators, no ink droplets are ejected from each of the plurality of nozzles.

9. The ink jet recording apparatus according to claim 1, wherein the abnormality judging portion is configured to judge that there exists the abnormality in at least one of: (a) one of the plurality of signal output circuits which corresponds to one of the plurality of individual electrodes as the at least one test-target individual electrode; and (b) one of the plurality of actuators which corresponds to the one of the plurality of individual electrodes, and the control device includes a pulse-width adjusting portion which adjusts a width of a pulse of a drive pulse signal to be outputted to the one of the plurality of individual electrodes for driving the one of the plurality of actuators, such that a volume of an ink droplet to be ejected from one of the plurality of nozzles that corresponds to the one of the plurality of actuators increases.

10. The ink-jet recording apparatus according to claim 1, wherein the abnormality judging portion is configured to judge that there exists the abnormality in any of the at least one of the plurality of actuators, and wherein the control device includes a recovery portion which gives a potential in which a difference with respect to the base potential is not smaller than a difference between the base potential and a drive potential for driving each of the plurality of actuators, to at least one of the plurality of individual electrodes including the at least one test-target individual electrode, for recovering an activity of said any of the at least one of the plurality of actuators.

11. The ink jet recording apparatus according to claim 1, further comprising a feed mechanism which feeds a recording medium, wherein the abnormality judging portion is configured to judge that there exists the abnormality in at least one of: (a) one of the plurality of signal output circuits which corresponds to one of the plurality of individual electrodes as the at least one test-target individual electrode; and (b) one of the plurality of actuators which corresponds to the one of the plurality of individual electrodes, and wherein the control device includes: an image-data storing portion configured to store image data of an image to be recorded on the recording medium that is fed by the feed mechanism; and an image-data modifying portion configured to modify data which is included in the image data stored in the image-data storing portion and which defines a volume of an ink droplet to be ejected from each of at least one of the plurality of nozzles located adjacent to one of the plurality of nozzles that corresponds to the one of the plurality of actuators, the data being modified such that the volume of the ink droplet increases.

12. The ink jet recording apparatus according to claim 11, wherein the image-data modifying portion is configured to modify data which defines a volume of an ink droplet to be ejected from each of at least one of two of the plurality of nozzles, which two nozzles are located on opposite sides of one of the plurality of nozzles that corresponds to the one of the plurality of actuators in a direction perpendicular to a direction of feeding of the recording medium, the data being modified such that the volume of the ink droplet increases.

13. The ink jet recording apparatus according to claim 1, comprising:

at least one actuator unit in each of which are unified ones of the plurality of actuators that constitute at least a part of the plurality of actuators;

at least one driver IC each of which includes ones of the plurality of signal output circuits which correspond to the ones of the plurality of actuators in a corresponding one of the at least one actuator unit, and an ink jet head in which are unified the at least one actuator unit, the at least one driver IC, and the flow-passage unit.

* * * * *